US012527401B2

(12) United States Patent
Gatfield et al.

(10) Patent No.: US 12,527,401 B2
(45) Date of Patent: Jan. 20, 2026

(54) SEATS

(71) Applicant: Resero IP Limited, Hamilton (NZ)

(72) Inventors: David Allan Gatfield, Hamilton (NZ); Shane Denis Inder, Hamilton (NZ); Andrew Hilton Kersley, Hamilton (NZ)

(73) Assignee: Resero IP Limited, Hamilton (NZ)

( * ) Notice: Subject to any disclaimer, the term of this patent is extended or adjusted under 35 U.S.C. 154(b) by 220 days.

(21) Appl. No.: 18/278,331

(22) PCT Filed: Feb. 24, 2022

(86) PCT No.: PCT/NZ2022/050021

§ 371 (c)(1),
(2) Date: Aug. 22, 2023

(87) PCT Pub. No.: WO2022/182254

PCT Pub. Date: Sep. 1, 2022

(65) Prior Publication Data

US 2024/0122348 A1 Apr. 18, 2024

(30) Foreign Application Priority Data

Feb. 24, 2021 (NZ) ..... 773287

(51) Int. Cl.
*A47C 1/032* (2006.01)
*A47C 1/033* (2006.01)
(Continued)

(52) U.S. Cl.
CPC ..... *A47C 3/0252* (2013.01); *A47C 1/03288* (2013.01); *A47C 3/03* (2013.01)

(58) Field of Classification Search
CPC ..... A47C 1/03288; A47C 3/03
(Continued)

(56) References Cited

U.S. PATENT DOCUMENTS 135,974 A 2/1873 Doremus
929,272 A 7/1909 Baron
(Continued)

FOREIGN PATENT DOCUMENTS

EP 368471 A * 5/1990 ..... A47C 1/03255
EP 0651958 B1 8/1998
(Continued)

OTHER PUBLICATIONS

International Search Report dated Apr. 22, 2022 in co-pending PCT Patent Application No. PCT/NZ2022/050021.

*Primary Examiner* — Rodney B White
(74) *Attorney, Agent, or Firm* — Thomas Horstemeyer, LLP

(57) ABSTRACT

A seat, such as a chair or stool, is disclosed and comprises a frame including at least one leg, an undercarriage which is configured to receive the leg, and a seat pan. The seat pan is rotatably mounted to the undercarriage, wherein the seat pan is rotatable about an axis of rotation relative to the undercarriage.

The undercarriage also includes a recess and a resilient component in the recess, while the seat pan includes a stop located on a bottom surface of the seat pan. On rotation of the seat pan relative to the undercarriage, such as may occur when the person seated leans forward or back, the resilient component is compressed between the undercarriage and the stop. In one embodiment, an axle passes through the axis of rotation and connects the legs, and potentially backrest if present, to the undercarriage.

23 Claims, 23 Drawing Sheets

(51) Int. Cl.
*A47C 3/025* (2006.01)
*A47C 3/03* (2006.01)

(58) Field of Classification Search
USPC ..... 297/314, 446.1
See application file for complete search history.

(56) References Cited

U.S. PATENT DOCUMENTS 1,270,729 A 6/1918 Harris
2,184,988 A 12/1939 Collier et al.
2,799,323 A 7/1957 Berg
3,039,818 A 6/1962 Frank
4,640,548 A * 2/1987 Desanta ..... A47C 1/03283 297/300.1
5,054,739 A * 10/1991 Wallin ..... B60N 2/39 297/314 X
5,409,295 A * 4/1995 Edstrom ..... A47C 3/0255 248/372.1
5,577,801 A * 11/1996 Glockl ..... A47C 3/025 297/312
5,590,930 A 1/1997 Glock
5,769,492 A * 6/1998 Jensen ..... A47C 9/002 297/314 X
6,033,021 A * 3/2000 Udo ..... A47C 9/002 297/314 X
6,604,784 B1 * 8/2003 Bosman ..... A47C 5/04 297/448.2
6,688,689 B1 * 2/2004 Thorn ..... A47C 7/14 297/314 X
6,866,340 B1 * 3/2005 Robertshaw ..... A47C 7/14 297/314 X
6,979,059 B1 * 12/2005 Conlin ..... A47C 7/448 297/314 X
7,100,983 B1 9/2006 Gant
7,380,879 B2 * 6/2008 Fletcher ..... A47C 3/12 297/270.1 X
7,686,396 B2 * 3/2010 Schaaf ..... A47C 3/0255 297/314 X
7,922,247 B2 * 4/2011 Dickie ..... A47C 7/14 297/314 X
8,029,060 B2 * 10/2011 Parker ..... A47C 7/004 297/314 X
11,439,235 B2 * 9/2022 Taylor, II ..... A47C 7/14
11,805,906 B2 * 11/2023 Taylor, II ..... A47C 7/448
11,957,246 B2 * 4/2024 Bisman ..... A47C 3/026
12,029,319 B2 * 7/2024 Lin ..... A47C 3/0255
12,089,741 B2 * 9/2024 Kamiya ..... A47C 1/03288
2002/0041118 A1 * 4/2002 Howell ..... A47C 1/03288 297/300.2
2002/0043846 A1 * 4/2002 Brauning ..... A47C 7/448 297/314
2003/0227210 A1 * 12/2003 Bosman ..... A47C 7/68 297/446.1 X
2005/0168030 A1 * 8/2005 Bykov ..... A47C 9/002 297/285
2009/0261642 A1 * 10/2009 Dickie ..... A47C 9/002 297/314
2019/0159596 A1 5/2019 DeSanta

FOREIGN PATENT DOCUMENTS

GB 2462496 A * 2/2010 ..... A47C 7/02
WO 2005039361 A2 5/2005

* cited by examiner

SEATS

CROSS REFERENCE TO RELATED APPLICATIONS

This application is the 35 U.S.C. § 371 national stage application of PCT Application No. PCT/NZ2022/050021 filed Feb. 24, 2022, which application claims the benefit of NZ No. 773287, filed Feb. 24, 2021, both of which are hereby incorporated by reference herein in their entireties.

FIELD OF TECHNOLOGY

The present technology relates to improvements to seats, particularly seats with an articulation mechanism for the seat pan and/or backrest of the seat.

BACKGROUND

Seats are articles on which people sit and are widely used in a variety of applications such as school and other learning environments, or offices and homes. Common types of seats include chairs having a seat pan and backrest, or stools which have only a seat pan. The seat pan (and backrest where applicable) is supported by a frame which bears the weight of the seat pan (and backrest where applicable) and a person sitting on the seat pan.

To improve the comfort and experience of sitting on a seat, it is common to include an articulation mechanism for at least one of the seat pan and the backrest.

The articulation mechanism facilitates the position and orientation of the seat pan and/or backrest to change with respect to the frame e.g. in response to a person's movement. Articulation mechanisms frequently include some form of biasing arrangement to provide a force to limit the change in position or orientation, or to provide a restorative force to return the seat pan or the backrest to a neutral position.

This movement can provide several benefits such as improved comfort, improved circulation, reduction in back pain, and preventing stress from concentrating in one part of the body. In learning environments, particularly for children, a seat having an articulation mechanism can improve concentration and learning outcomes.

However, seats which allow reclining are more complex in construction. They typically have a relatively large part count and can be complex to assemble.

Another common problem with seats is that they are relatively bulky. This increases shipping and storage requirements costs due to the space that each seat occupies. To offset this, it is known to sell or transport seats as a kitset, either partially or fully assembled. However, those kitsets can be difficult to assemble, requiring specialist skills and/or tools.

SUMMARY

According to one aspect of the present technology, there is provided a seat which comprises at least one leg, a seat pan, and an undercarriage, wherein the at least one leg is attached to the undercarriage, and further wherein the seat pan is rotatably attached to the undercarriage.

According to one aspect of the technology, there is provided a kitset of parts which can be assembled to form a seat, wherein the kitset comprises:

at least one leg, an undercarriage, and a seat pan, wherein the at least one leg and the undercarriage are configured to be attached to each other, and further wherein the seat pan and the undercarriage are configured to be attached so that in use the seat pan can rotate relative to the undercarriage.

According to another aspect of the technology, there is provided a seat which comprises a seat pan, an undercarriage, and one or more resilient components located between the seat pan and the undercarriage, wherein the seat pan is rotatable with respect to the undercarriage, and wherein in use rotation of the seat pan with respect to the undercarriage compresses the resilient components between the seat pan and the undercarriage.

According to another aspect of the technology, there is provided a kitset of parts that can be assembled to form a seat, wherein the kitset comprises a seat pan, an undercarriage, and one or more resilient components, wherein when the kitset is assembled the seat pan is rotatable with respect to the undercarriage, and further wherein the resilient element is between the seat pan and the undercarriage.

According to another aspect of the present technology, there is provided a seat which comprises a frame including at least one leg that is configured to bear down on a surface, an undercarriage which is configured to receive the leg, a seat pan which is rotatably mounted to the undercarriage, wherein the seat pan is rotatable about an axis of rotation relative to the undercarriage, and wherein the undercarriage includes a recess and a resilient component in the recess, wherein the seat pan includes a stop located on a bottom surface of the seat pan, and further wherein, on rotation of the seat pan relative to the undercarriage, the resilient component is compressed between the undercarriage and the stop.

According to another aspect of the technology, there is provided a kitset of parts that can be assembled to form a seat, wherein the kitset comprises a frame including at least one leg that is configured to bear down on a surface, an undercarriage which is configured to receive the leg, a seat pan which is rotatably mounted to the undercarriage, wherein the seat pan is rotatable about an axis of rotation relative to the undercarriage, and wherein the undercarriage includes a recess and a resilient component in the recess, wherein the seat pan includes a stop located on a bottom surface of the seat pan, and further wherein, on rotation of the seat pan relative to the undercarriage, the resilient component is compressed between the undercarriage and the stop.

The present specification describes improvements to seats. In preferred embodiments the improvements described herein can be implemented together in a product assembled from a kitset. However, it should be appreciated that the improvements may be implemented separately of each other, and so the description herein should not be seen as limiting on the scope of the technology.

Throughout the present specification, reference to the term "seat" should be understood as meaning a piece of furniture on which a person can sit.

In an embodiment, the seat may be a chair e.g. which has a backrest and a seat pan and unless otherwise stated, shall be referred to as such throughout the remainder of the specification. In another embodiment, the seat be a stool which has a seat pan but no (or substantively no) backrest.

Throughout the present specification, reference to the term "seat pan" should be understood as meaning one or more components that provide(s) a surface on which a person sits.

In an embodiment, the seat pan may be a single component.

In a preferred embodiment, the seat pan may be made of a mouldable material such as, but not limited to, plastic, metal or reinforced materials.

The seat pan may include a top surface and a bottom surface, and in use a person can sit on the top surface.

In preferred embodiments, the present invention may include a frame.

Throughout the present specification, reference to the term "frame" should be understood as meaning a structure to support one or more components of the seat above the ground. The frame bears down onto the ground over which the seat is positioned.

For instance, the frame may include the one or more legs, and the undercarriage. In addition, the frame may include a backrest support (as is discussed in more detail below).

In an embodiment, the frame may include two legs e.g. a pair of legs.

However, in an alternative embodiment, the frame may include a pedestal e.g. a single leg with a plurality of feet attached thereto.

In a preferred embodiment, the leg(s) may be substantially C-shaped e.g. when viewed from a lateral side of the chair. This leg configuration is typical of a reverse cantilever chair.

In a particularly preferred embodiment, each C-shaped leg may have a first portion, an upper portion and a middle portion. The first portion may be configured to bear down on a surface on which a seat rests. The upper portion may be configured to engage with the undercarriage to facilitate attachment of the two components together. The middle portion may be configured to transmit weight from the upper portion to the first portion.

In a further preferred embodiment, the first portion and the upper portion of each leg may be substantially parallel to each other.

In an alternative embodiment, each leg may be shaped in the form of a continuous loop.

In an alternative embodiment, one or more legs may be constructed by attaching multiple components together.

In an embodiment, the leg(s) may be formed from a mouldable material such as, but not limited to, metal, plastic, graphite-reinforced material or fibre-reinforced material.

In an embodiment, the seat includes a seat pan which is attached to at least a portion of one or more legs.

In a preferred embodiment, the present technology may include an articulation mechanism.

Throughout the present specification, reference to the term "articulation mechanism" should be understood as meaning an arrangement to facilitate movement of one component of the seat relative to another.

In a preferred embodiment, the articulation mechanism may comprise a seat pan articulation mechanism.

The seat pan articulation mechanism is configured to, in use, facilitate rotational movement of the seat pan relative to the undercarriage.

In a preferred embodiment, the rotational movement of the seat relative to the undercarriage is achieved through an axis of rotation passing through a portion of the seat pan and the undercarriage.

In a preferred embodiment, the articulation arrangement may comprise a backrest articulation mechanism.

The backrest articulation mechanism is configured to, in use, facilitate rotational movement of the backrest relative to the backrest support.

In an embodiment, the lower surface of the seat pan may have a fulcrum.

Throughout the present specification, reference to the term "fulcrum" should be understood as meaning a component around which the seat is configured to rotate.

In an embodiment, the seat rotates around an axis of rotation which passes through the fulcrum.

In a preferred embodiment, the fulcrum may be so oriented that the axis of rotation is away from the bottom surface of the seat.

In a preferred embodiment, the fulcrum may have a triangular cross-section with a base and a vertex which are opposite to each other. The base may be configured to lie on the bottom surface of the seat and the vertex configured to point away from the bottom surface.

In an embodiment, the fulcrum and the seat may be configured to be formed together.

In an alternative embodiment, the fulcrum may be attached to the seat.

In an embodiment, one or more axles may be configured to pass through the fulcrum.

Throughout the present specification, reference to the term "axle" should be understood as meaning a component which is located along the axis of rotation around which the seat rotates.

In one embodiment, the seat may be configured to rotate around one axle. In an alternative embodiment, the seat may be configured to rotate around a plurality of axles, wherein all the axles lie on a single axis of rotation.

In a preferred embodiment, the axle(s) pass through the substantially triangular fulcrum near the corner which is farthest from the bottom surface of the seat.

In an embodiment, the one or more axles is/are configured to be attached to the leg(s). In an alternative embodiment, the one or more axles is/are configured to pass through the leg(s).

In yet another alternative embodiment, the one or more axles is/are configured to not be attached to the leg(s).

In an embodiment, the one or more axles is/are configured to be attached to the backrest support. In an alternative embodiment, the one or more axles is/are configured to pass through the backrest support.

In yet another alternative embodiment, the one or more axles is/are configured to not be attached to the backrest support.

In an embodiment, rotation of the seat is configured to be regulated by one or more resilient components.

Throughout the present specification, reference to the term "resilient component" should be understood as meaning a component which is configured to provide resistive force to rotation of the seat pan or backrest and which provides a restorative force to return the seat pan or backrest to a neutral position.

In an embodiment, rotation of the seat pan in a first direction is regulated by a first resilient component.

In a preferred embodiment, the first resilient component is located towards the front of the seat.

In another embodiment, rotation of the seat pan in a second direction is regulated by a second resilient component.

In a preferred embodiment, the second resilient component is located towards the rear of the seat pan.

In a preferred embodiment, the first resilient component and the second resilient component may have the same modulus of elasticity.

In an alternative embodiment, the first resilient component and the second resilient component may have different moduli of elasticity.

In a preferred embodiment, the modulus of elasticity of the first resilient component may be lesser than the modulus of elasticity of the second resilient component. This provides greater resistance when a person seated in the furniture reclines.

Throughout the present specification, reference to the term "undercarriage" should be understood as meaning a component which is located beneath the seat pan and to which the seat pan is rotatably attached.

In a preferred embodiment, the undercarriage may be configured to be attached to the leg(s).

In an embodiment, the undercarriage may include one or more slots or channels that are each configured to receive a portion of a respective the leg.

In a particularly preferred embodiment, the undercarriage includes a first slot or channel to receive at least a portion of the first leg and a second slot or channel to receive at least a portion of the second leg. Preferably in this embodiment, the openings to the first and second slots or channels are at or proximate the portion of the undercarriage corresponding to the rear of the seat pan in use.

In an embodiment, the first leg may be secured to the undercarriage by one or more fasteners e.g. in the first slot. Similarly, the second leg may be secured to the undercarriage by one or more fasteners e.g. in in the second slot.

In an alternative embodiment, at least one of the leg(s) or the undercarriage may be configured to provide a snap-fit attachment to attach the leg(s) to the undercarriage. For instance, the first leg may be snap-fitted to the first slot and the second leg may be snap-fitted to the second slot. Alternatively, the leg(s) may be inserted in a push-fit arrangement into the respect first and second slots.

In an embodiment, the undercarriage is structured to receive the resilient component(s). For instance, the undercarriage may include one or more recesses to receive a respective resilient element. In use, rotation of the seat pan compresses the resilient element between a surface of the seat pan and the respective recess. This is discussed in more detail below.

In an embodiment, the undercarriage is structured to receive additional accessories or attachments. Non-limiting examples of such accessories and attachments includes a mounting arm for electronic devices such as tablets, arm rests, and storage brackets or baskets or the like.

In an embodiment, the seat may include a backrest.

Throughout the present specification, reference to the term "backrest" should be understood as meaning a set of components to provide support to a person's back when sitting on the seat.

In an embodiment, the backrest may be formed from a mouldable material, such as, but not limited to, plastic, metal, reinforced materials, etc.

In a preferred embodiment, the backrest may be a single component.

The backrest includes a front surface and a rear surface. The front surface is conventionally configured to be towards a person seated in the seat.

In an embodiment, the backrest may include a backrest fulcrum.

Throughout the present specification, reference to the term "backrest fulcrum" should be understood as meaning a component around which the backrest rotates.

In an embodiment, the backrest rotates around an axis of rotation which passes through the backrest fulcrum.

In an embodiment, the backrest fulcrum is located on the rear surface of the backrest.

In a preferred embodiment, the backrest fulcrum may be located towards a lower end of the backrest.

In another embodiment, the backrest fulcrum may be so oriented that the axis of rotation of the backrest is away from the rear surface of the backrest.

In a preferred embodiment, the backrest fulcrum may have a triangular cross-section with a base and a vertex. The base may lie on, or be formed integrally to, the rear surface of the backrest while the vertex may point away from the rear surface.

In a preferred embodiment, the seat may include at least one backrest axle.

Throughout the present specification, reference to the term "backrest axle" should be understood as meaning a component which provides an axle around which the backrest can rotate in use.

In an embodiment, the backrest fulcrum and the and the backrest may be formed together as a single component.

In an alternative embodiment, the backrest fulcrum may be attached to the backrest.

In an embodiment, one or more backrest axles may pass through the backrest fulcrum.

In a preferred embodiment, the backrest axle(s) pass through the substantially triangular backrest fulcrum near the corner which is farthest from the rear surface of the backrest.

In an embodiment, the one or more backrest axles is/are configured to be attached to a backrest support.

In a preferred embodiment, the seat may include a backrest support.

Throughout the present specification, reference to the term "backrest support" should be understood as meaning a component that attaches the backrest to the undercarriage and which in use supports the backrest with respect to the undercarriage.

In an embodiment, the undercarriage may include one or more backrest support slots or channels that are configured to receive at least a portion of the backrest support.

In an embodiment, the backrest support may be substantially linear or substantially non-linear.

In a preferred embodiment, the backrest support may have a substantially U-shaped portion.

In a preferred embodiment, the backrest support may include two free ends.

The backrest support may form part of a frame of the seat when attached to the undercarriage.

In another preferred embodiment, the two free ends may be configured to be received by a respective one of the backrest support slots.

In an embodiment, rotation of the backrest may be regulated by one or more backrest resilient components.

Throughout the present specification, reference to the term "backrest resilient component" should be understood as meaning a resilient component which is configured to provide resistive force to rotation of the backrest and which provides a restorative force to return the seat pan or backrest to a neutral position.

In an embodiment, the backrest resilient component may be spaced apart from and above the backrest fulcrum.

In a preferred embodiment, the backrest resilient component may be located close to an upper end of the backrest.

In an embodiment, the seat may further include one or more stops.

Throughout the present specification, reference to the term "stop" should be understood as meaning components that restrict the range of rotation of the seat pan around the axle or the backrest around the backrest axle.

In a preferred embodiment, the seat may include a first stop that restricts the range of rotation of the seat pain in a first direction.

In another preferred embodiment, the seat may include a second stop that restricts the range of rotation of the seat in a second direction.

In an embodiment, the first resilient component may be configured to be compressed between the first stop and a portion of the undercarriage in use, when a person leans forward.

In a preferred embodiment, the first resilient component may be configured to be compressed between the first stop and a first recess of the undercarriage in use, when a person leans forward.

In another embodiment, the second resilient component may be compressed between the second stop and a portion of the undercarriage in use, when a person reclines backward.

In a preferred embodiment, the second resilient component may be compressed between the second stop and a second recess of the undercarriage in use, when a person reclines backward.

In an embodiment, the stop(s) may be attached to the seat pan.

In a preferred embodiment, the stop(s) may be formed integrally to the seat pan.

In an embodiment, the backrest may include one or more backrest stop(s) that restrict the range of rotation of the backrest.

In a preferred embodiment, the backrest resilient component may be configured to be compressed between the backrest stop and a rear surface of the backrest.

In an embodiment, the backrest stop(s) may be attached to the backrest.

In a preferred embodiment, the stop(s) may be formed integrally to the backrest.

Further aspects of the technology, which should be considered in all its novel aspects, will become apparent to those skilled in the art upon reading of the following description which provides at least one example of a practical application of the technology.

BRIEF DESCRIPTION OF THE DRAWINGS

One or more embodiments of the technology will be described below by way of example only, and without intending to be limiting, with reference to the following drawings, in which.

DETAILED DESCRIPTION

Figure 1:
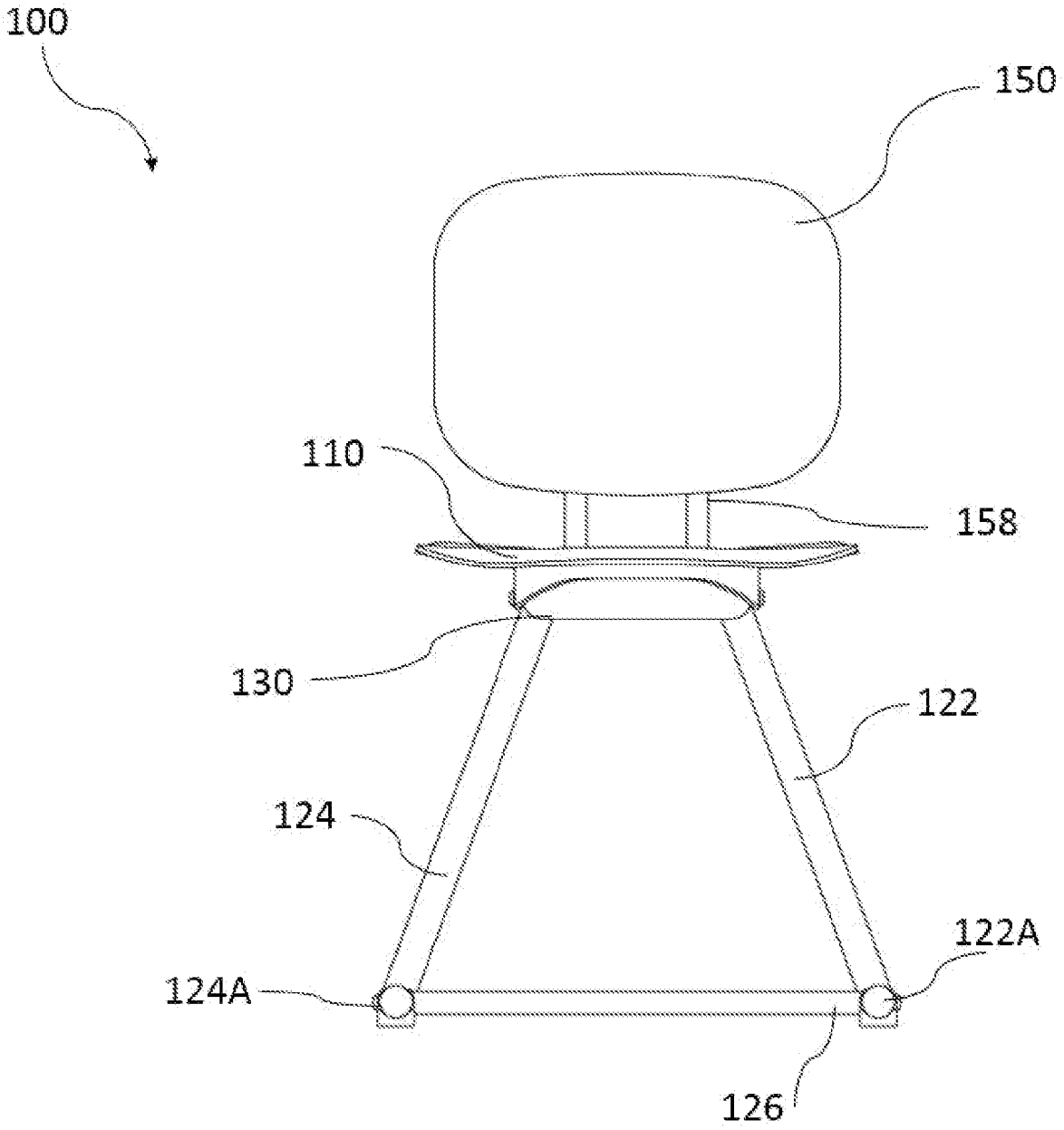
FIG. 1 is a front view of a chair according to an embodiment of the present technology.
Figure 2:
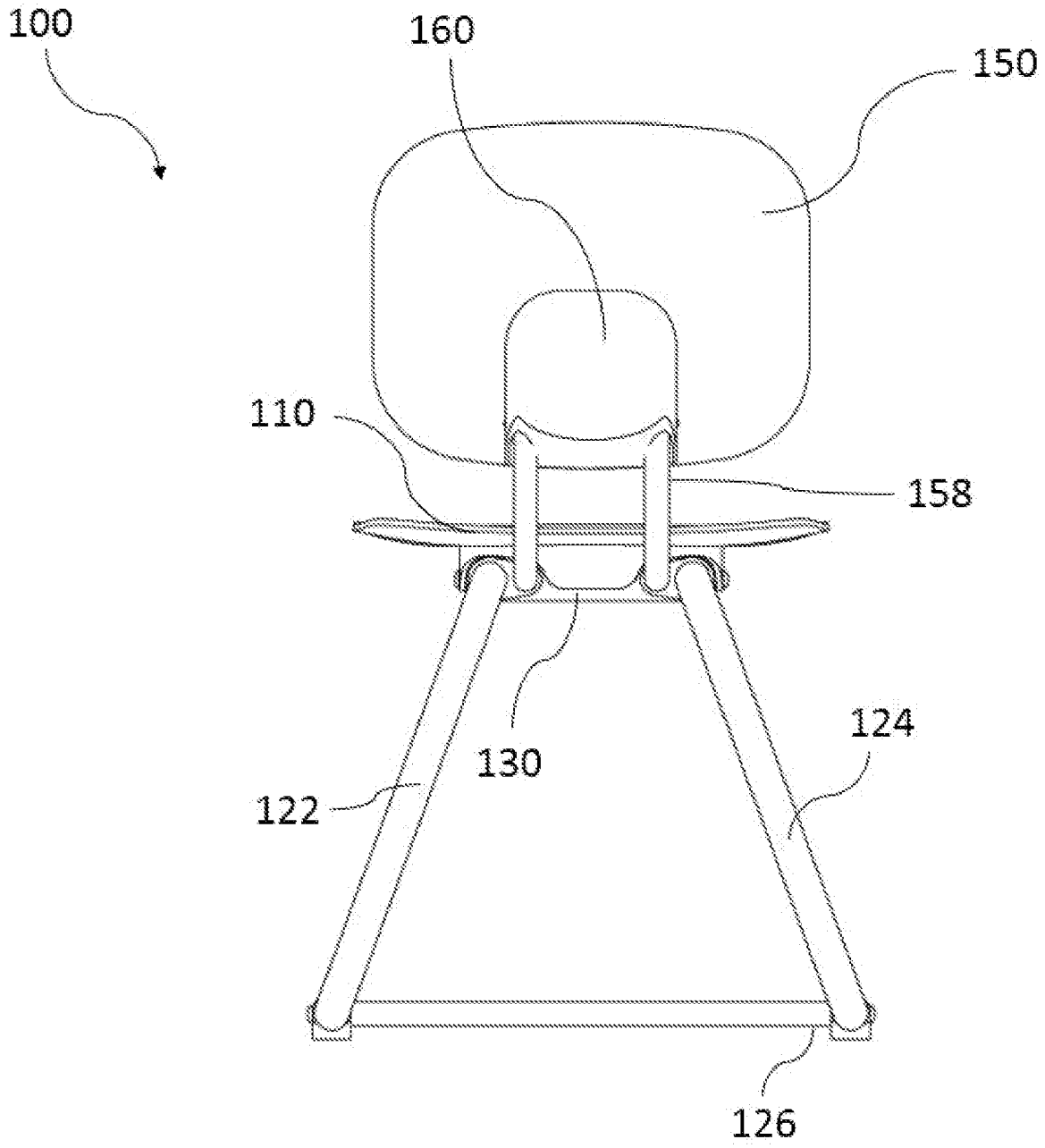
FIG. 2 is a rear view of a chair according to an embodiment of the present technology.
Figure 3:
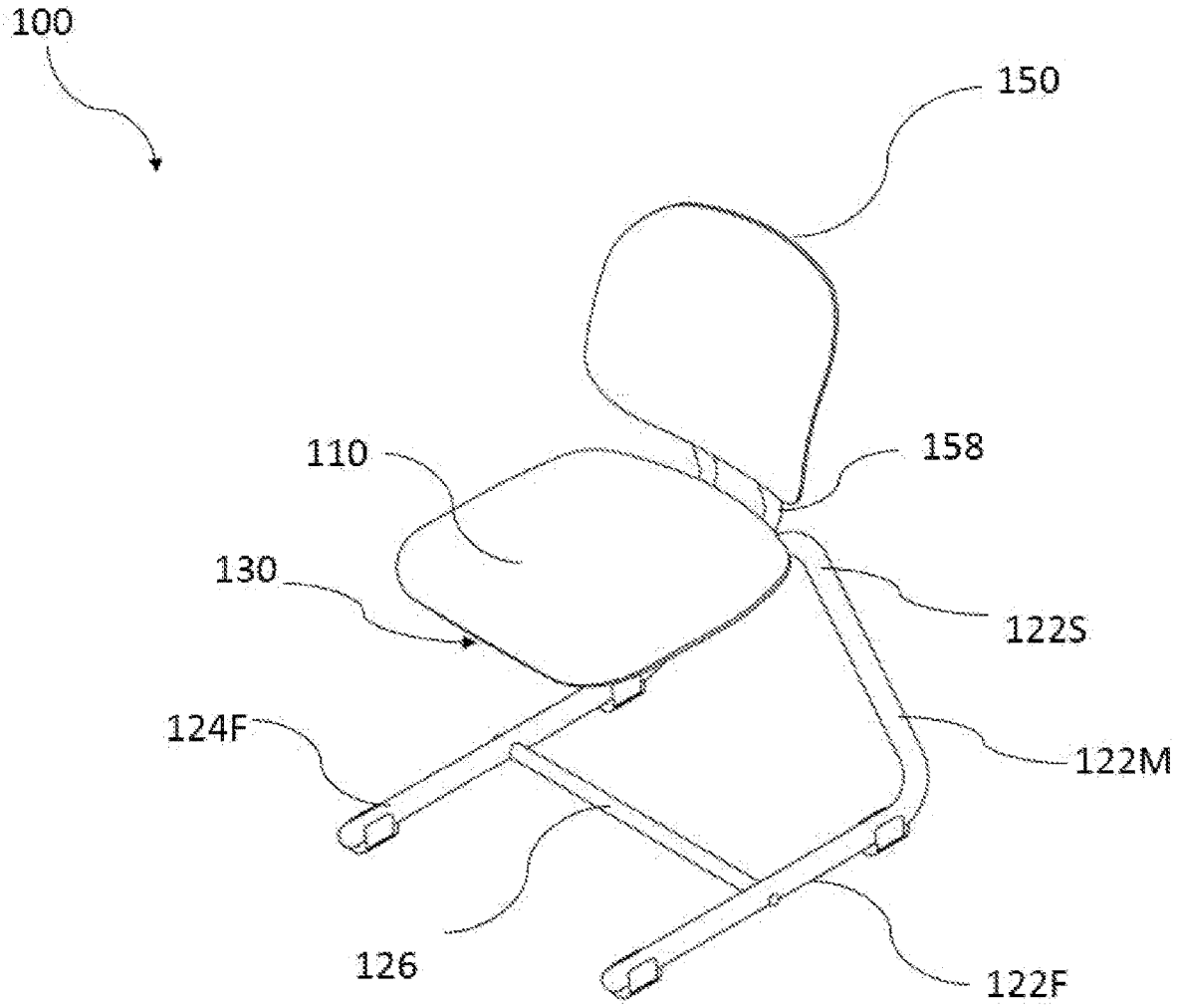
FIG. 3 is a front perspective view of a chair according to an embodiment of the present technology.
Figure 4:
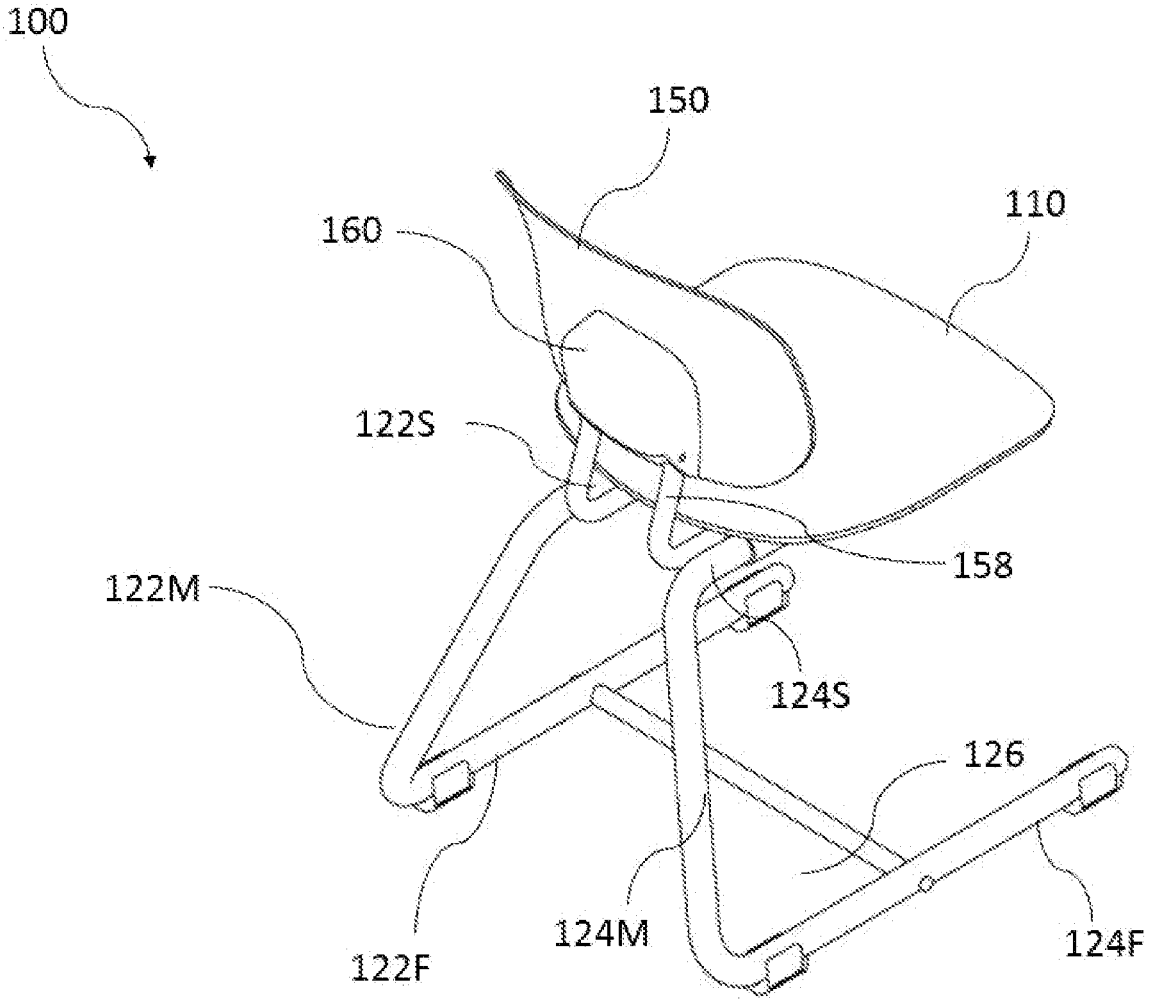
FIG. 4 is a rear perspective view of a chair according to an embodiment of the present technology.
Figure 5:
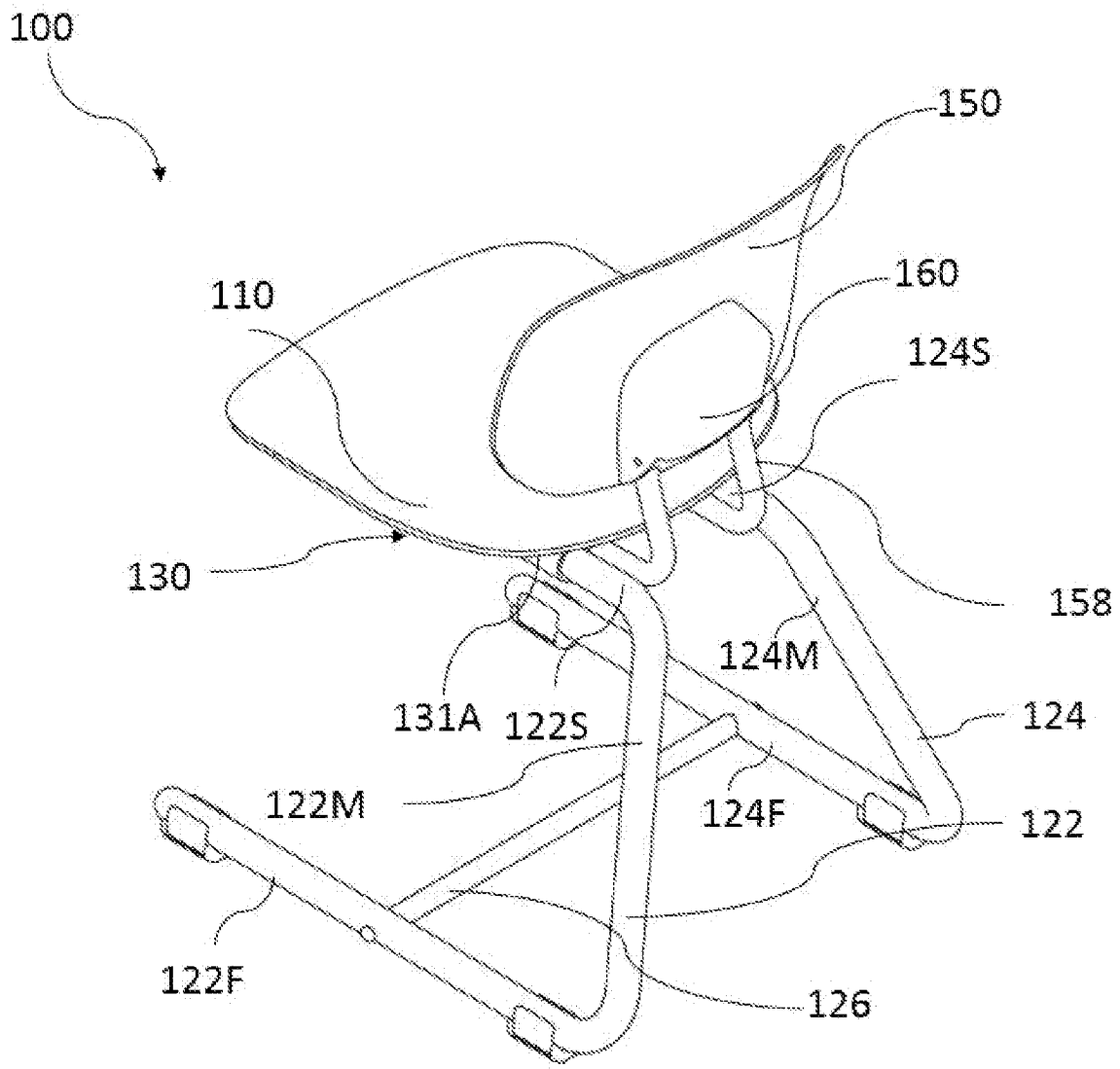
FIG. 5 is another rear perspective view of a chair according to an embodiment of the present technology.

It is an object of the technology to provide an improved seat.

Alternatively, it is an object to provide a seat which can be more easily or cheaply transported.

Alternatively, it is an object to provide a seat which optimises use of storage space.

Alternatively, it is an object to provide a seat which is stackable.

Alternatively, it is an object to improve storage on other furniture items e.g. table-tops.

Alternatively, it is an object to provide a seat with a reduced part count compared to other seats.

Alternatively, it is an object to provide a seat which is easier to assemble than existing seats, and does not require specialist tools or skills such as welding.

Alternatively, it is an object to provide a seat which is easy to disassemble.

Alternatively, it is an object to provide a seat which allows parts to be easily replaced.

Alternatively, it is an object to provide a seat which reduces chances of incorrect assembly.

Alternatively, it is an object to provide a seat whose production can be automated.

Alternatively, it is an object to provide a seat whose production is more easily scalable.

Alternatively, it is an object to provide a seat which is strong.

Alternatively, it is an object to provide a seat which is durable.

Alternatively, it is an object to provide a seat with a high strength to weight ratio.

Alternatively, it is an object to provide a seat with a high strength to volume ratio.

Alternatively, it is an object to provide a seat which is safe.

Alternatively, it is an object to provide a seat which is stable in use.

Alternatively, it is an object to provide a seat which has desirable or improved ergonomics.

Alternatively, it is an object to provide a seat with an improved articulation mechanism for a seat pan.

Alternatively, it is an object to provide a seat with an improved articulation mechanism for a backrest.

Alternatively, it is an object to provide a seat having a desired range of motion for the seat pan (and backrest where applicable).

Alternatively, it is an object of the technology to at least provide the public with a useful choice.

Chair

Referring first to FIGS. 1 to 14 which show views of a seat according to an embodiment of the present technology, in the form of a chair 100 and components therefor. In general, the chair 100 includes a seat pan 110, a backrest 150, a frame having legs (122 and 124) and a backrest support 158.

Figure 6:
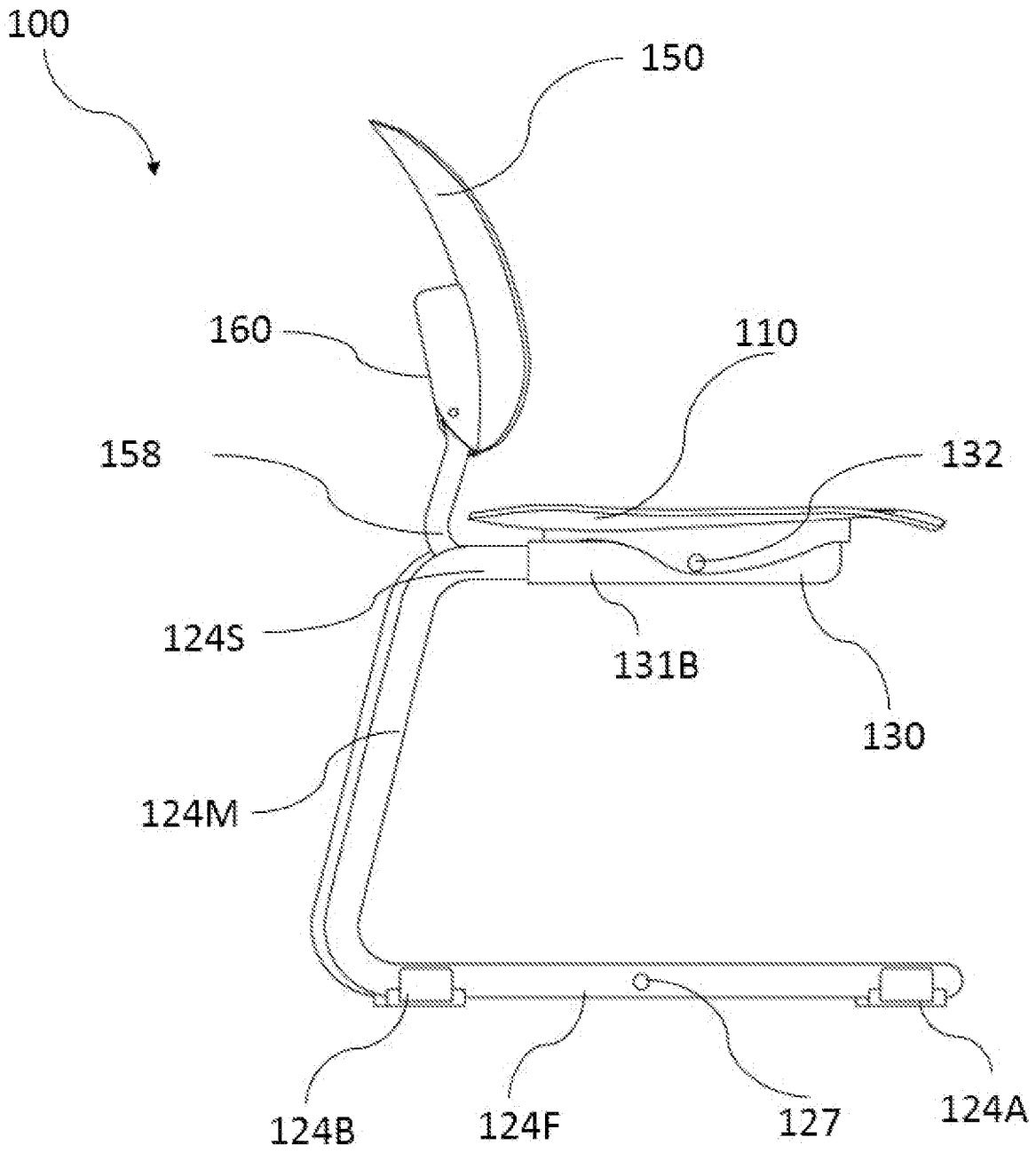
FIG. 6 is a side view of a chair according to an embodiment of the present technology.
Figure 7:
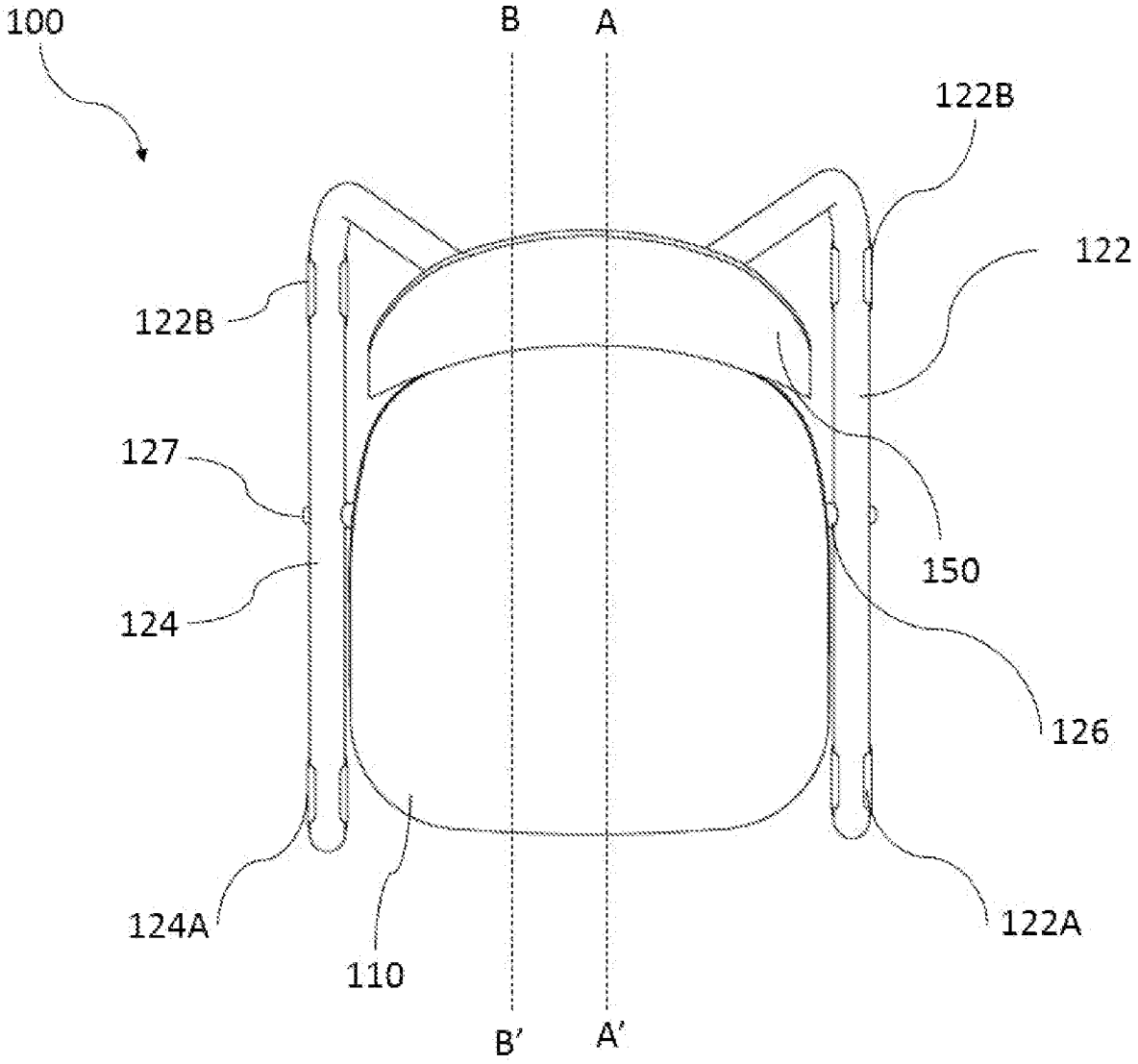
FIG. 7 is a top view of a chair according to an embodiment of the present technology.
Figure 8:
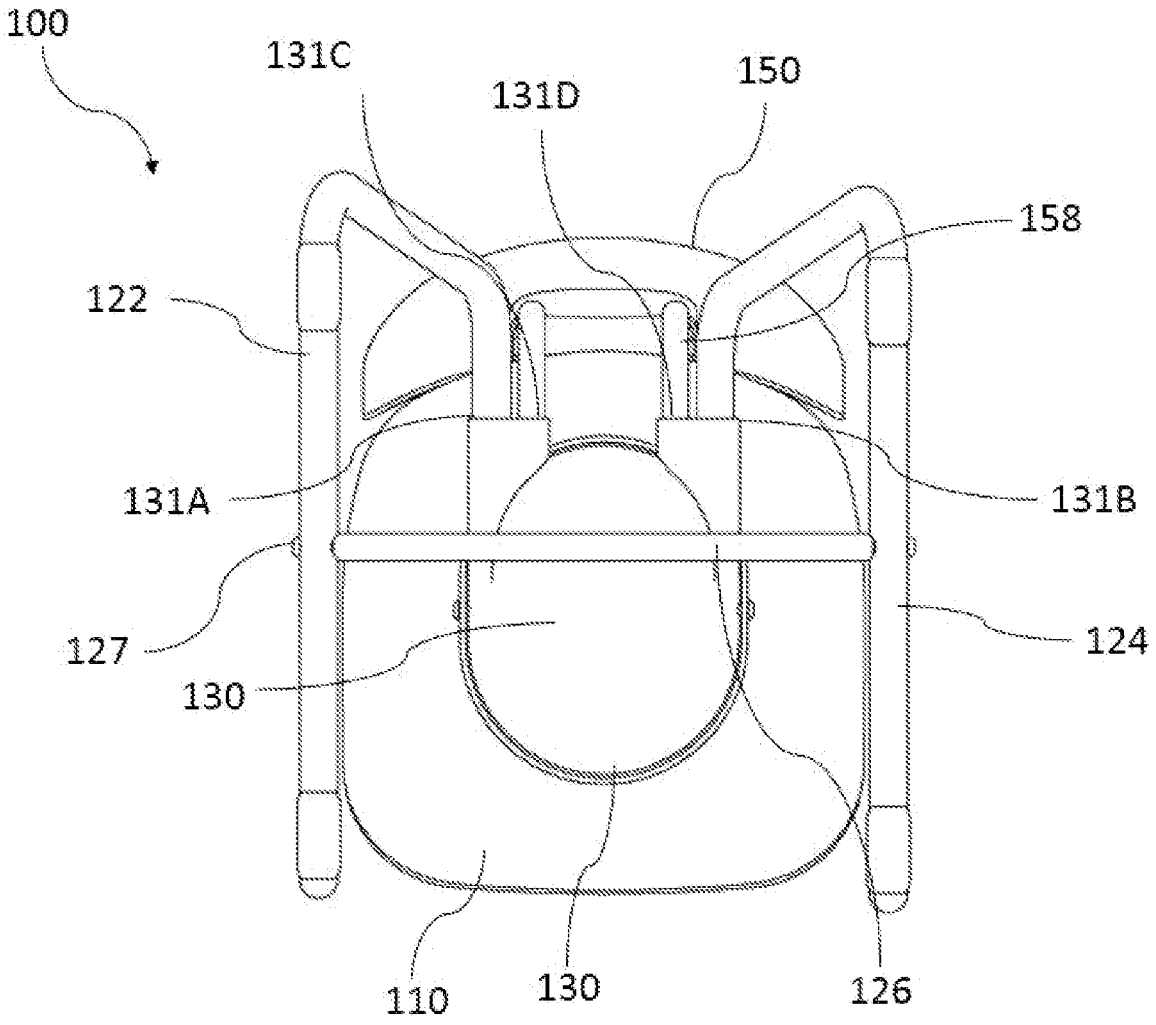
FIG. 8 is a bottom view of a chair according to an embodiment of the present technology.

The pair of legs 122, 124 generally have a "C" shaped-profile when viewed from the left hand or right hand side, as is perhaps best illustrated in FIG. 6. Each leg 122, 124 includes a first portion 122F, 124F, a middle portion 122M, 124M, and an upper portion 122S, 124S, which together define the "C" shape for the respective legs 122, 124. This shape is often referred to as a reverse cantilever and permit a degree of flex in response to a loading, such as a person being seated, on the chair.

The first portion 122F, 124F of the respective legs 122, 124 is orientated to in use bear down on ground (not marked in the Figures) on which the chair 100 may be positioned.

The chair 100 includes an undercarriage 130. The undercarriage 130 serves as a structural cross-member for the chair and receives the upper portion 122S, 124S of the respective legs 122, 124. This arrangement is useful since it permits flex, arising from the weight and movement of the person sitting in the chair, due to the configuration of the legs as a reverse cantilever. In this manner, comfort may be increased for the person sitting in the chair. A similar effect may be achieved when the chair uses gas-springs or the like.

The rear of the undercarriage 130, which in use is proximate the backrest 150, includes a first leg slot or channel 131A and a second leg slot or channel 1313 that are each configured to receive a respective one of the upper portions 122S, 124S. This may be in a snap-lock or push-fit arrangement. When the upper portions 122S, 124S are located within the slot or channels 131A, 1313, it adds to the overall structural strength of the undercarriage.

The undercarriage 130 is relatively low profile, with no or minimal projections depending downwards. This better facilitates stacking multiple chairs on top of each other or on another surface, e.g. a table top. To help minimise risk of slippage on the surface on which the undercarriage has been placed, all or a portion of the surface of the undercarriage may include a coating of non-slip material (not shown in Figures). The undercarriage may additionally be provided with fittings or structures (not shown in Figures) that permit the mounting of chair accessories; such accessories could include arm rests or mounting bars for arms, arrangements for holding electronic devices, or even storage brackets or baskets or the like.

The seat pan 110 is moveably mounted to the undercarriage 130 e.g. it is rotatable relative to the undercarriage 130. This enables the seat pan 110 to tilt forward and backward in use (as is discussed in more detail below).

A backrest support 158 is provided to connect the backrest 150 to the undercarriage 130. In the illustrated embodiment, the backrest support 158 has a first end 158A and a second end 158B, which are connected together by a mid-section 158L.

The undercarriage 130 includes a first backrest support slot or channel 131C and a second backrest support slot or channel 131D which are each configured to receive a respective one of the first end 158A and the second end 158B. This may be in a snap-lock or push-fit arrangement. As with the upper portions 122S, 124S of the respective legs 122, 124, once the first end 158A and second end 158B of the backrest is inserted into the undercarriage via the slot or channels 131C, 131D, it contributes to the overall structural strength of the undercarriage.

The backrest 150 has a cavity (indicated generally as 151) which is configured to receive at least a portion of the mid-section 158L. A cover plate 160 can be used to sandwich and hold the mid-section 158L in the cavity 151.

The backrest 150 is moveable with respect to the backrest support 158 e.g. it can rotate with respect to the backrest support 158 (as is discussed in more detail below).

In use, a person sits on the seat pan 110. Their weight on the seat pan 110 is transferred to the upper portions 122S, 124S and down to the respective first portions 122F, 124F by the respective mid-section 122M, 124M.

The legs 122, 124 are braced together by a brace member 126 e.g. which is attached between the first portions 122F, 124F. The brace member 126 can prevent the legs 122, 124 from splaying outwards under the force(s) that may be experienced in use. In the illustrated embodiment, the brace member 126 is attached to the first portions 122F, 124F of the legs 122, 124 through fasteners 127.

The first leg 122 and the second leg 124 are provided with at least one foot each e.g. a forward foot 122A, 124A and a rearward foot 122B, 124B. Each foot 122A, 124A, 122B, 124B is made from a material which has a relatively high coefficient of friction e.g. rubber. Therefore, each foot 122A, 124A, 122B, 124B may assist in preventing or limiting slipping of the chair 100 in use.

The feet 122A, 124A, 122B, 124B may be made from a material that enables a certain amount of slip to allow sliding across the ground on which the chair 100 is positioned.

However, the feet 122A, 124A, 122B, 124B may also be made of nylon, rubber, or any other suitable material.

Figure 9:
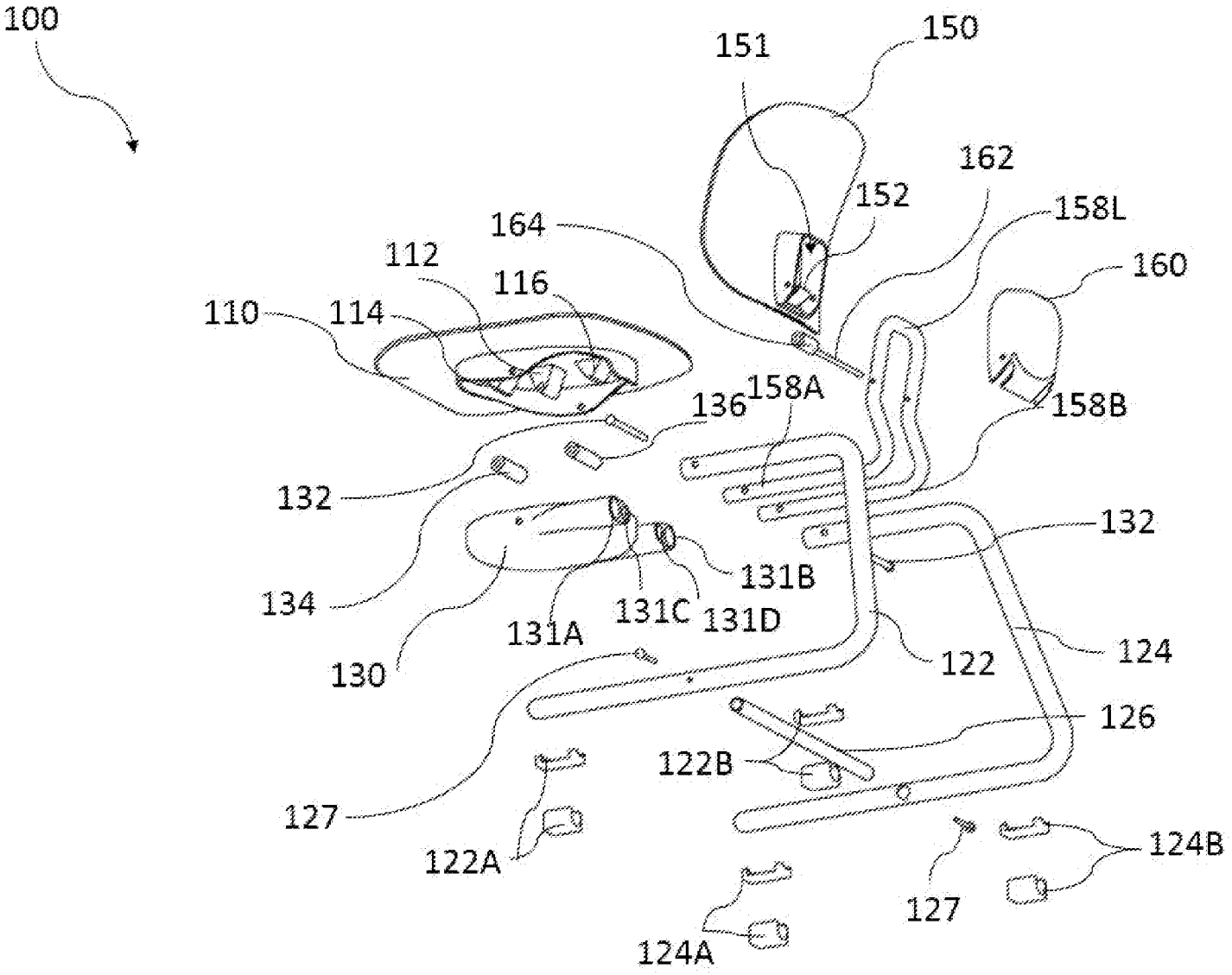
FIG. 9 is an exploded view of a chair according to an embodiment of the present technology.

As shown in FIG. 9, each foot 122A, 124A, 122B, 124B may include two components for ease of assembly.

FIG. 9 shows an exploded view of components of the chair 100.

Referring now to FIGS. 9A, 9B, 9C and 9D, it will be seen that the seat pan 110 includes a seat fulcrum 112, a first stop 114 and a second stop 116 which are all provided on a lower side of the seat pan 110.

The undercarriage 130 includes a fulcrum recess 139 formed on an upper side of the undercarriage, a first recess 137 and a second recess 138, which accommodate the seat fulcrum 112, the first stop 114 and the second stop 116 respectively.

In the illustrated embodiment, the seat pan 110, the seat fulcrum 112, the first stop 114 and the second stop 116 are formed together as a single component e.g. by plastic injection moulding. However, the components of the seat pan 110 could be formed separately and attached together e.g. by plastic welding or fasteners such as screws. Alternatively, certain components may be inserted as snap-lock structures; e.g. the first stop 114 may be moulded separated and inserted into a recess moulded to the lower side of the seat pan in a snap-lock fit.

The undercarriage 130 includes the first recess 137 and the second recess 138. Each of the recesses 137, 138 is configured to receive and support one of a first resilient component 134 and a second resilient component 136 respectively (as shown in exploded view FIG. 9).

The first resilient component 134 is located towards a front of the undercarriage 130, in front of the seat fulcrum 112. The second resilient component 136 is located towards a rear of the undercarriage 130, behind the seat fulcrum 112. It will be understood that the rear of the undercarriage corresponds to the rear of the seat pan 110, being proximate to the backrest 150.

The first resilient component 134 is located between the first stop 114 and the first recess 137 in the undercarriage 130. The second resilient component 136 is located between the second stop 116 and the second recess 138 in the undercarriage 130.

Figure 9A:
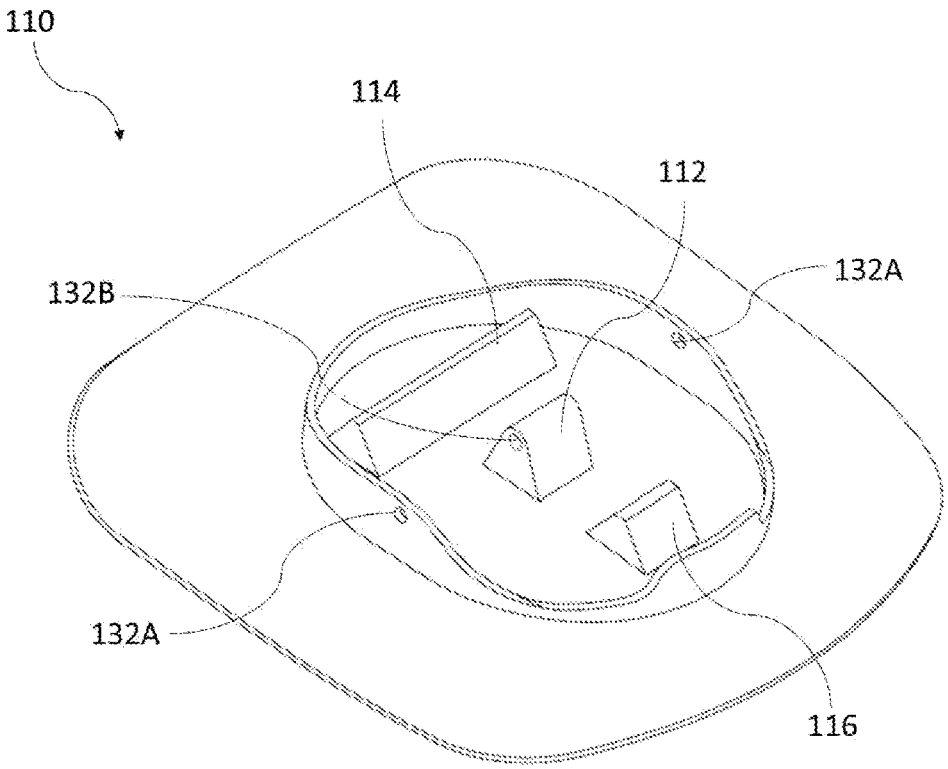
FIG. 9A is a bottom perspective view of a seat pan according to an embodiment of the present technology.
Figure 9B:
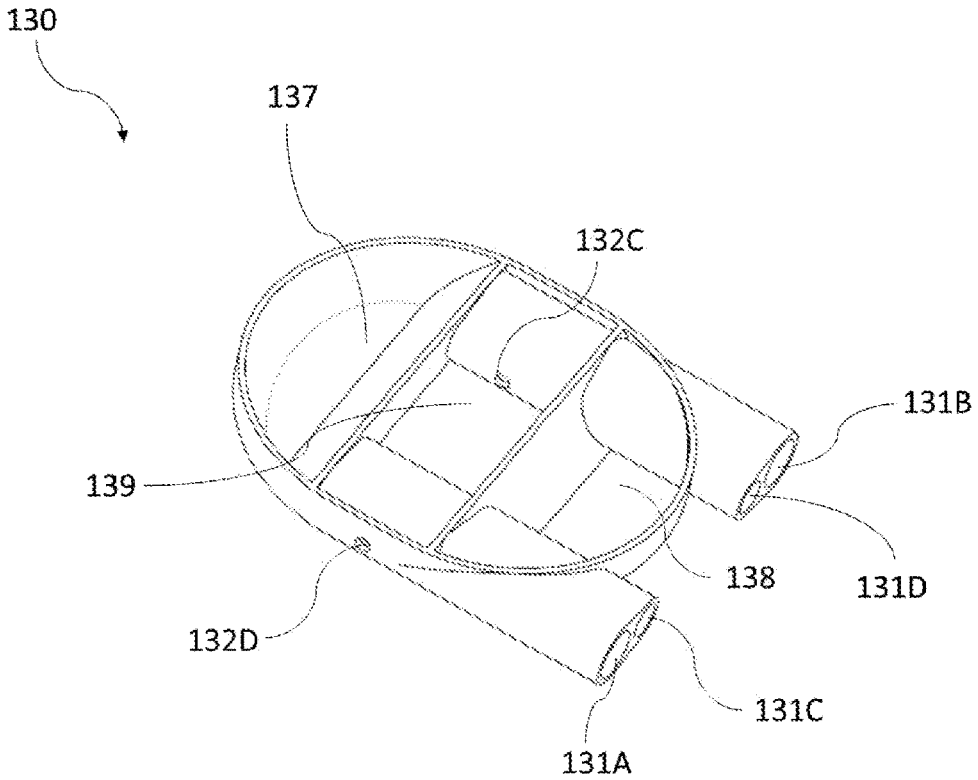
FIG. 9B is a top perspective view of an undercarriage according to an embodiment of the present technology.
Figure 9C:
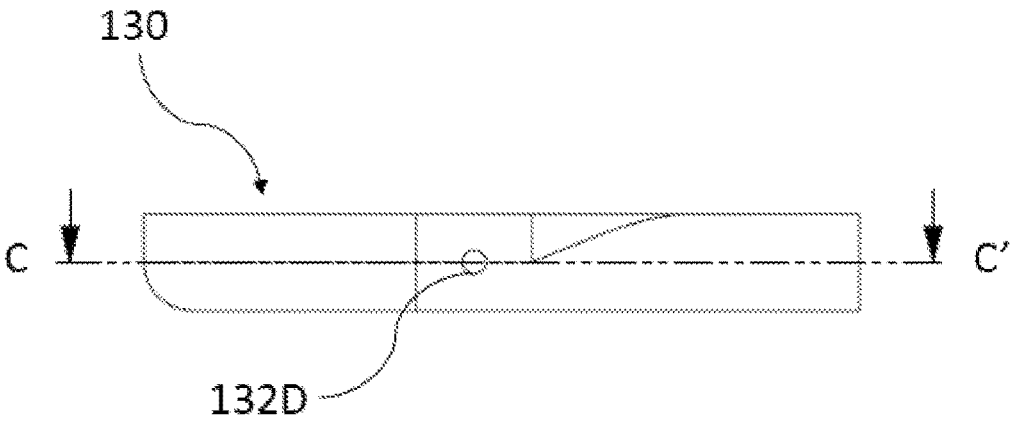
FIG. 9C is a side view of the undercarriage of FIG. 9B.
Figure 9D:
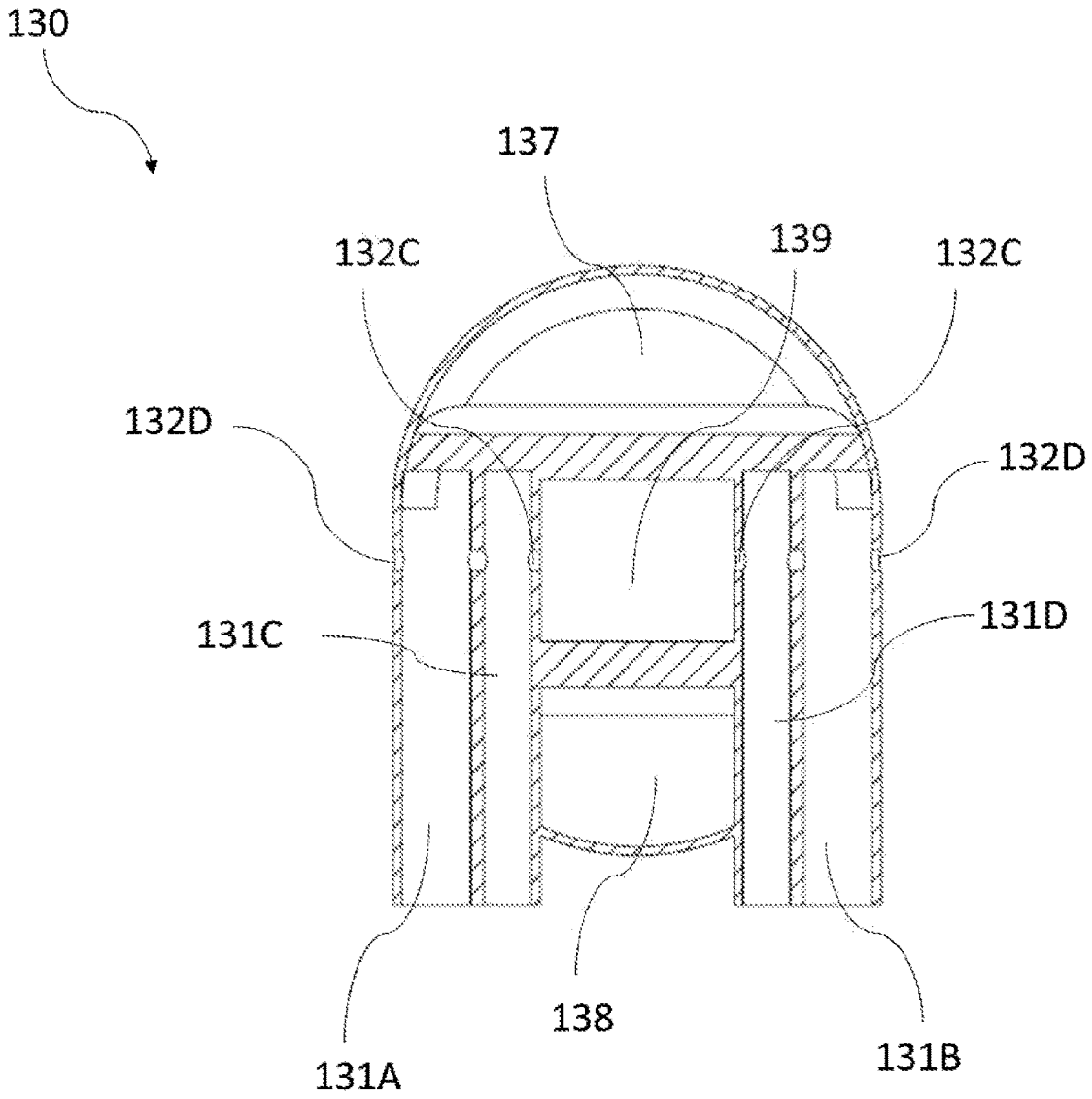
FIG. 9D is a top cross-sectional view of the undercarriage along section C-C' shown in FIG. 9C.
Figure 10:
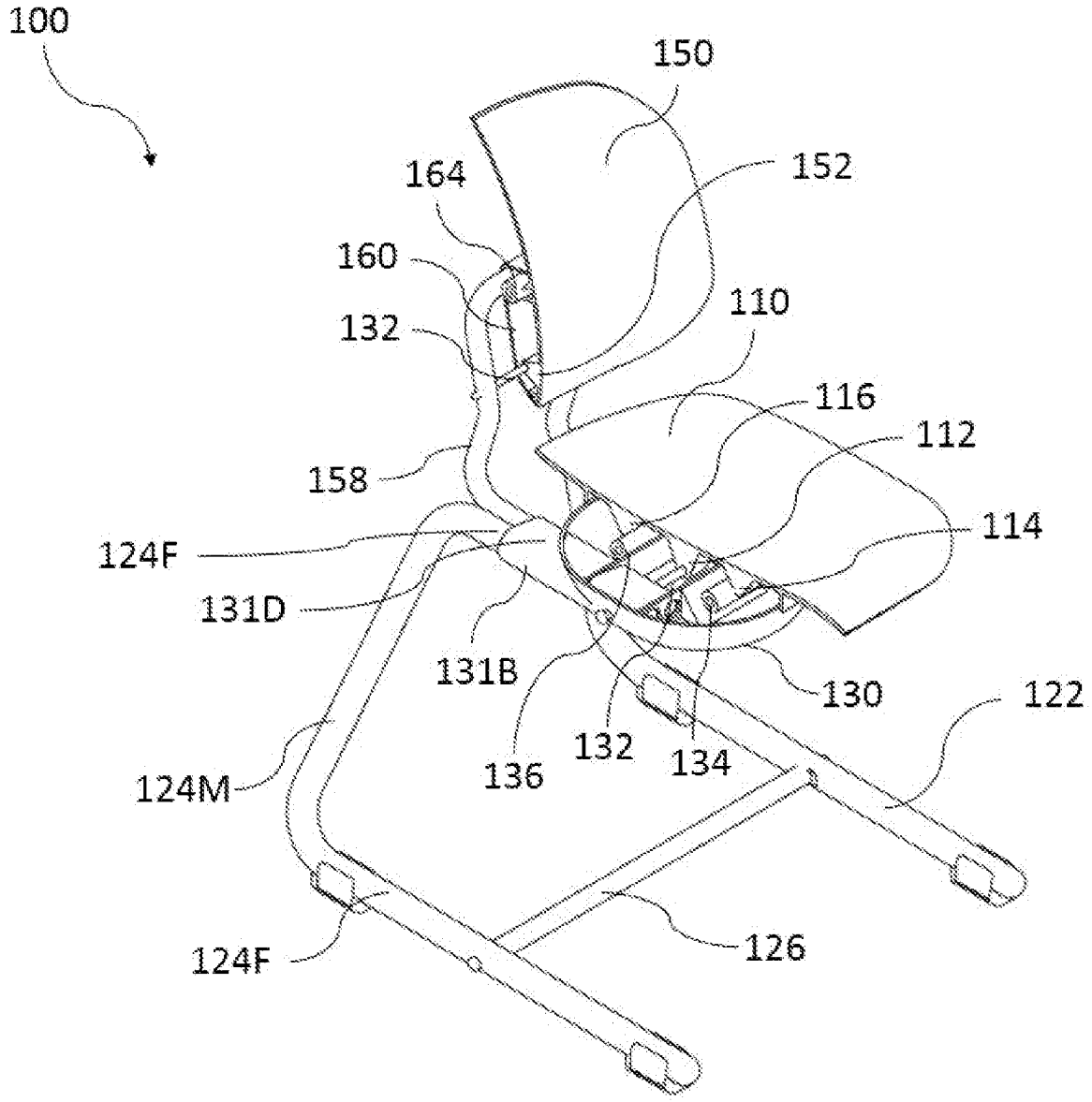
FIG. 10 is a partial cross-sectional view along section A-A' shown in FIG. 7.
Figure 11:
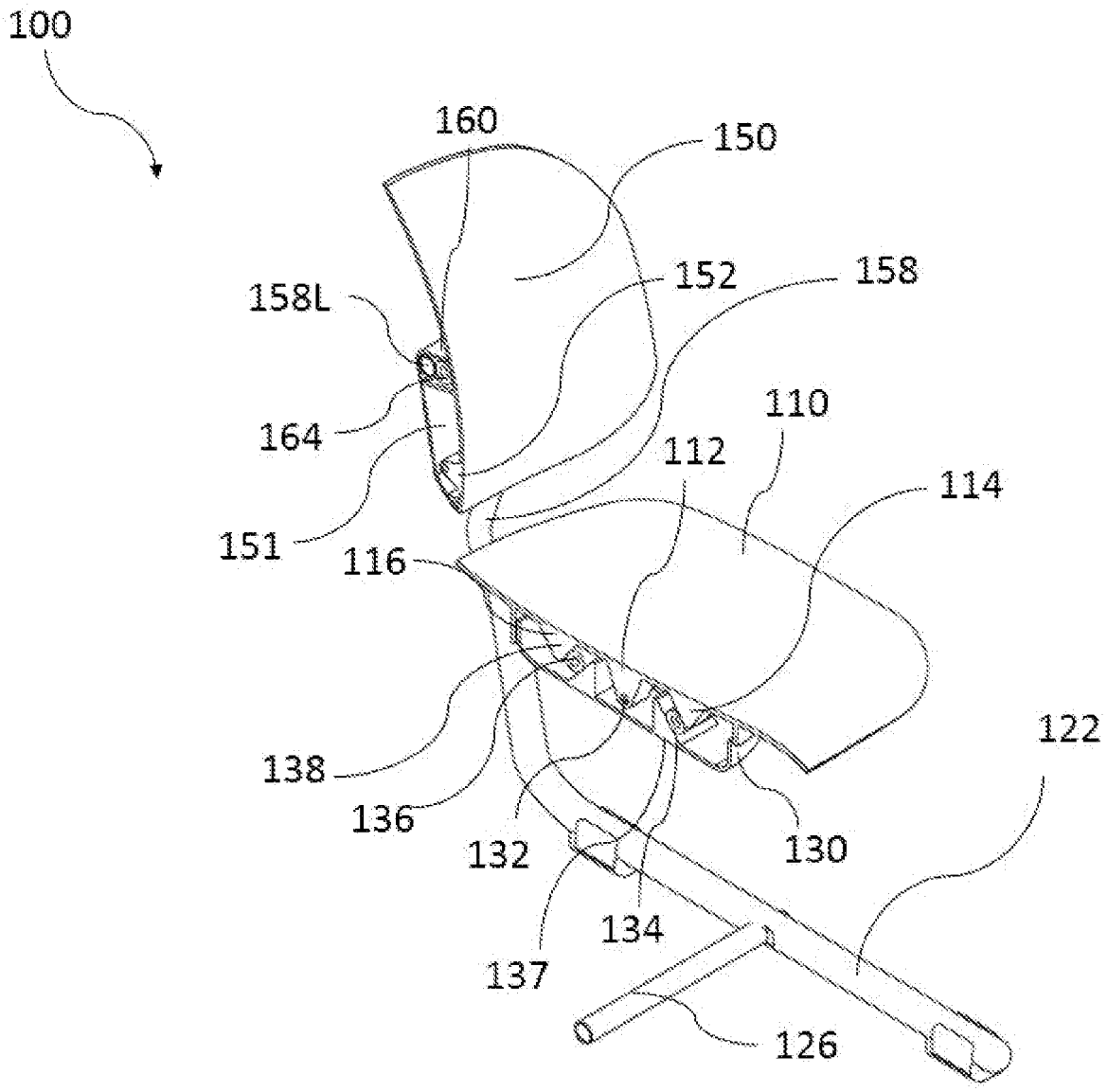
FIG. 11 is a perspective cross-sectional view along section A-A' shown in FIG. 7.
Figure 12:
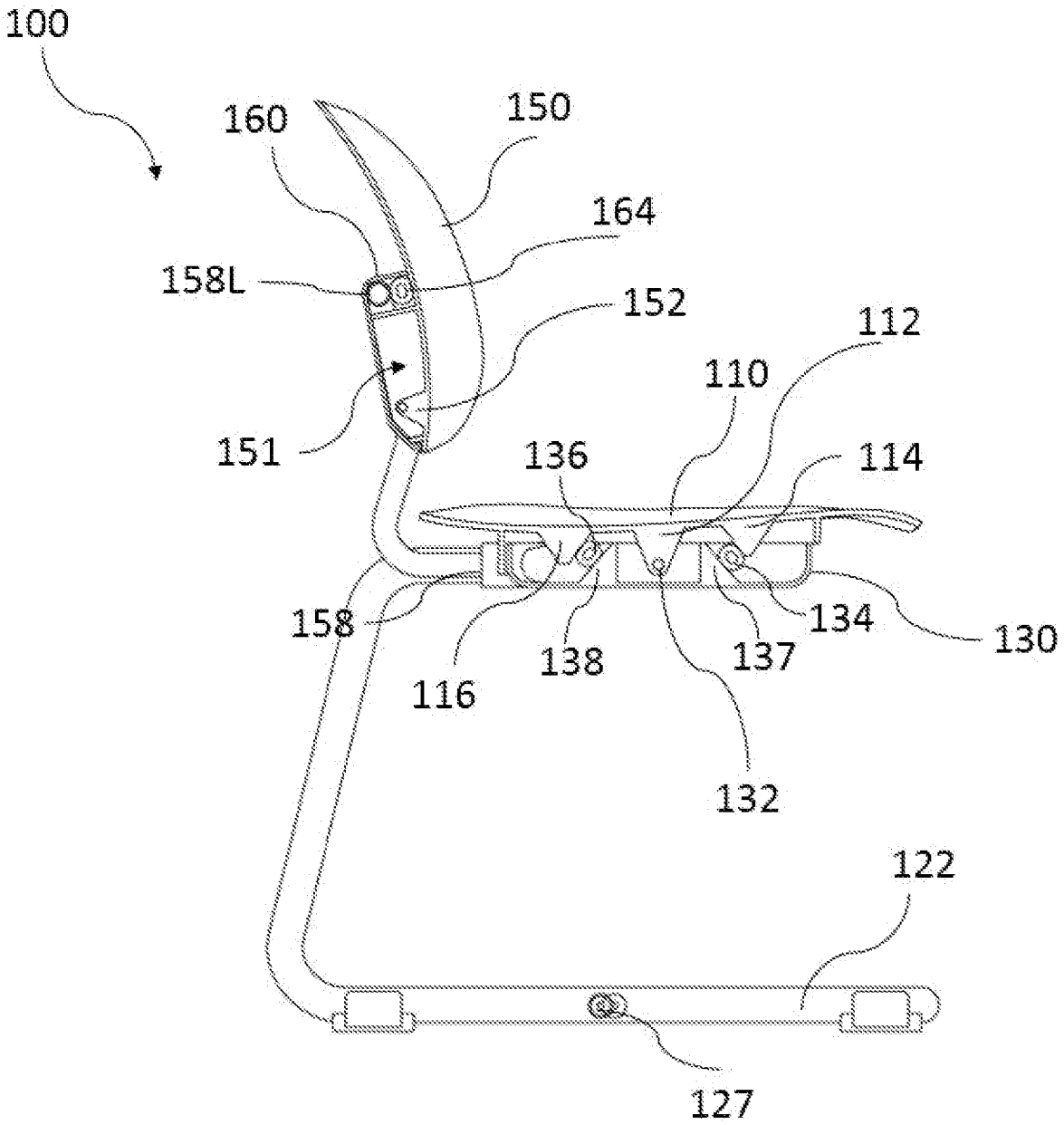
FIG. 12 is a side cross-sectional view along section A-A' shown in FIG. 7.

As seen in FIG. 9D, the slots or channels 131A, 1313 that receive the upper portions of the respective legs (not shown in this Figure) extend someway into the undercarriage. This increases the contact between the respective surfaces. Although not shown here, the end of the slots or channels 131A, 1313, proximate the first recess 137 may be provided with protrusions that extend into the ends of the upper portions of the legs and assist in locating them firmly within the undercarriage. Similarly, the slots or channels 131C, 131D that receive the first end and second ends of the backrest (not shown in this Figure) extend someway into the undercarriage. Again this provides increased contact between the respective contact surfaces of the undercarriage and backrest.

Figure 13:
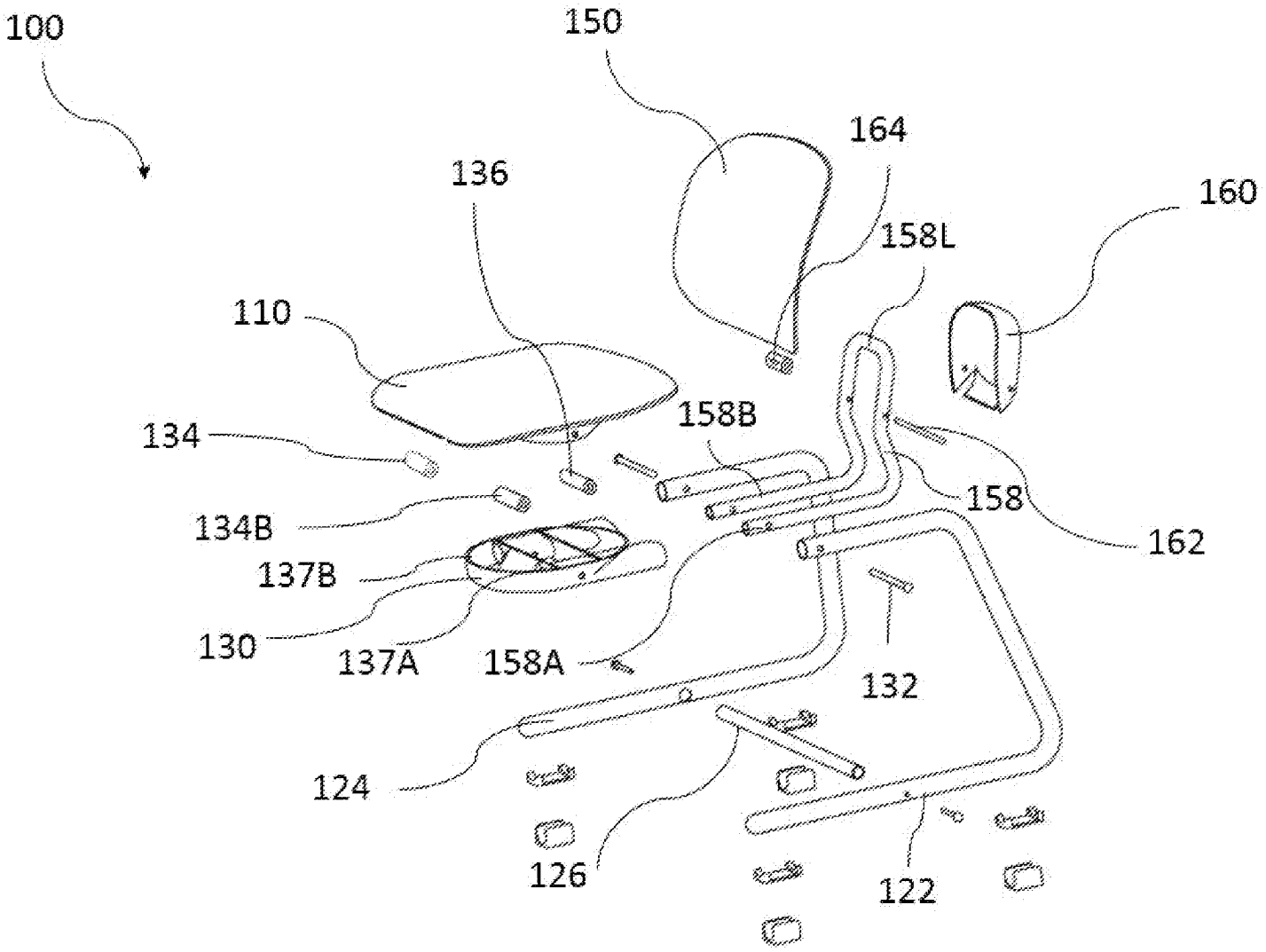
FIG. 13 is an exploded view of the components of the chair according to according to an embodiment of the present technology.

In an alternative embodiment, shown in FIG. 13, the chair 100 includes a third resilient component 1343. The first resilient component 134 and the third resilient component 1343 are both located towards the front of the seat pan 110 but are laterally spaced from each other. The first recess may be provided as two discrete recesses e.g. a first recess 137A to receive the first resilient component 134 and a second recess 137B to receive the third resilient component 134B, as shown in FIG. 13.

The chair 100 may further include at least one seat axle 132 to provide an axle about which the seat pan 110 can rotate. In the embodiment illustrated in FIG. 13, the seat pan 110 is configured to rotate about a single axle 132.

As illustrated, in the preferred embodiment of FIG. 9, the chair 100 includes two seat axles 132, which are each located on the lateral (left hand and right hand) sides of the seat pan 110. Both of the seat axles 132 may be configured to lie on a single axis of rotation.

The seat axle(s) 132 extend through a respective aperture 132A in a flange formed in an underside of the seat pan 110, and into a corresponding aperture 132B in the respective seat fulcrum 112.

Figure 14:
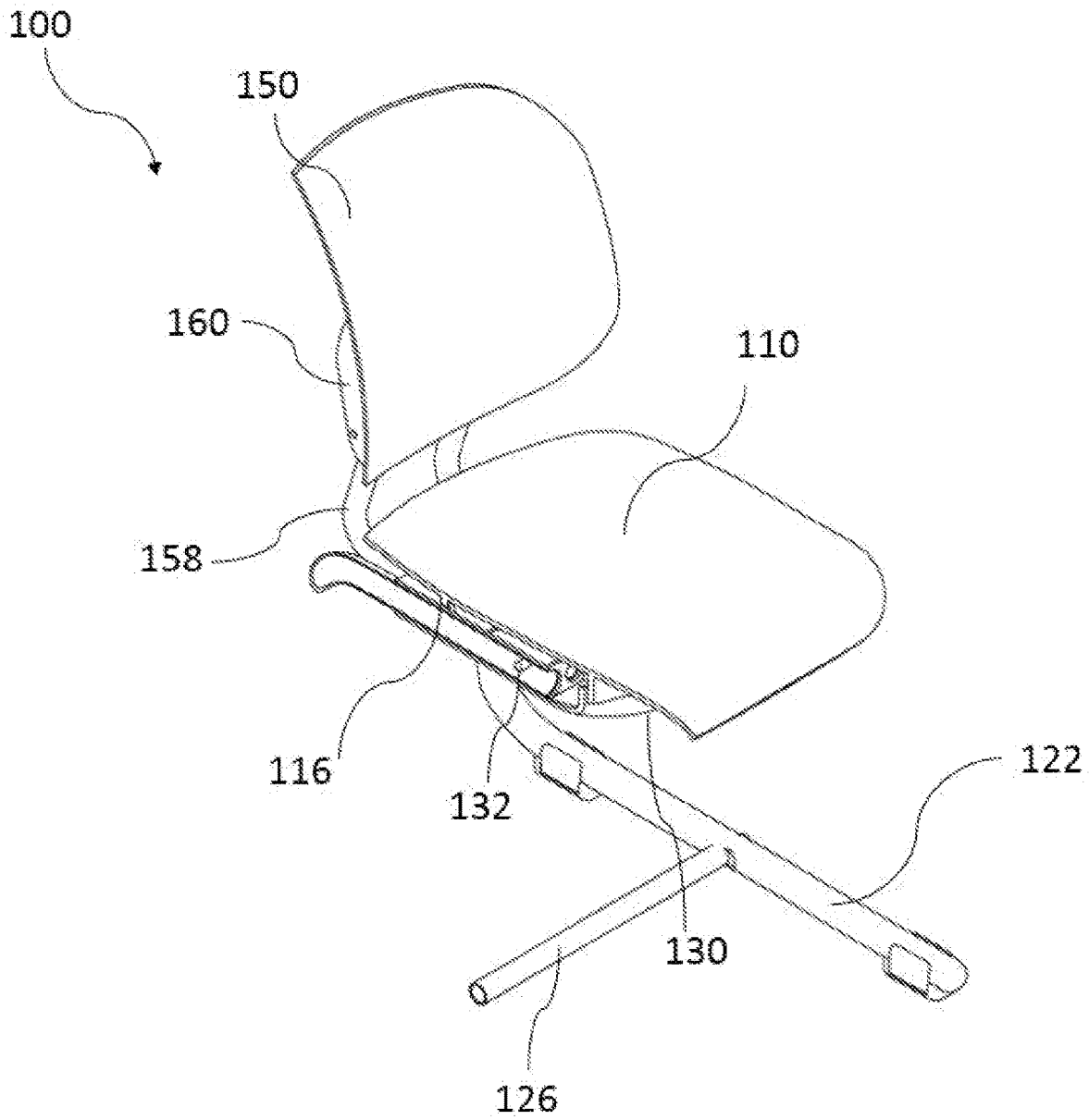
FIG. 14 is a front prospective cross-sectional view along section B-B' shown in FIG. 7.

The seat axle(s) 132, in the embodiment of FIGS. 9A, 9B and 14 are configured to pass through the undercarriage 130 as well as the legs 122, 124. The axle(s) 132, in this embodiment, serves to retain the upper portions 122S, 124S in the first leg slot 131A and the second leg slot 131B respectively. This is helpful for ease and/or greater automation of manufacture, ease of assembly and for reduction of parts; the seat axle(s) 132 functions as a retention member, locking the legs 122, 124 to the undercarriage 130. As previously noted, the legs 122, 124 contribute to the structural strength and integrity of the undercarriage 130. The axles may also serve as a means for securing additional fittings or structures (not shown in Figures) that permit the mounting of chair accessories, such as arm rests, storage components and arms to which electronic devices may be attached.

Using the axle(s) 132 as a retention member may simplify manufacture by better facilitating automation of the assembly of the chair. It can also simplify manual assembly, even for relatively unskilled persons, e.g. school children. The chair 100 can be quickly erected from a stored condition, where the legs 122, 124 and/or backrest 150 have been removed due to storage constraints. Once the legs 122, 124 are located within the undercarriage 130, they can be locked in place by passing the axle(s) through, and the backrest 150, if present.

In the illustrated embodiment, the undercarriage 130 includes apertures 132C to correspond with the apertures 1326, and apertures 132D to correspond with apertures 132A. The axle(s) 132 are configured to pass through the apertures 132A, 1326, 132C and 132D, and therefore through the legs 122, 124 and the backrest if present. Alternatively, the seat axle(s), in an embodiment not shown in any of the Figures, is/are configured to pass only through the undercarriage 130, but not the legs 122, 124. The apertures designated 132C in FIG. 9D, would be in this alternative unillustrated embodiment, would be located above what would be the first leg slot 131A, the second leg slot 1316 and the backrest slots 131C, 131D.

In an alternative embodiment (also not shown in any of the Figures), tilting of the seat may be achieved without an axle e.g. there is no discrete axle component. The seat pan may have a cylindrical protrusion, and the undercarriage may have a socket which is configured to receive the cylindrical protrusion. The seat pan may be configured to rotate with respect to the undercarriage via the cylindrical protrusion and socket.

As shown in, for example FIGS. 9 to 12, a backrest resilient component 164 is positioned between the mid-section 158L of the backrest support 158 and a surface of the cavity 151 in the backrest 150.

Articulation Mechanism and Range of Motion

Figure 15:
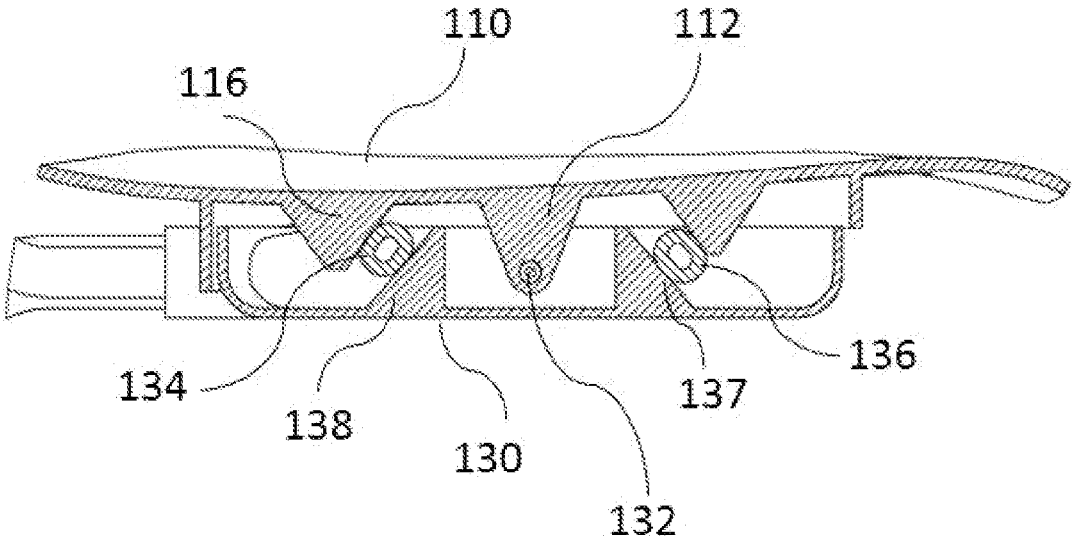
FIG. 15 is a cross-sectional view of an articulation mechanism showing a seat pan tilted in a first (reclined) direction according to an embodiment of the present technology.
Figure 16:
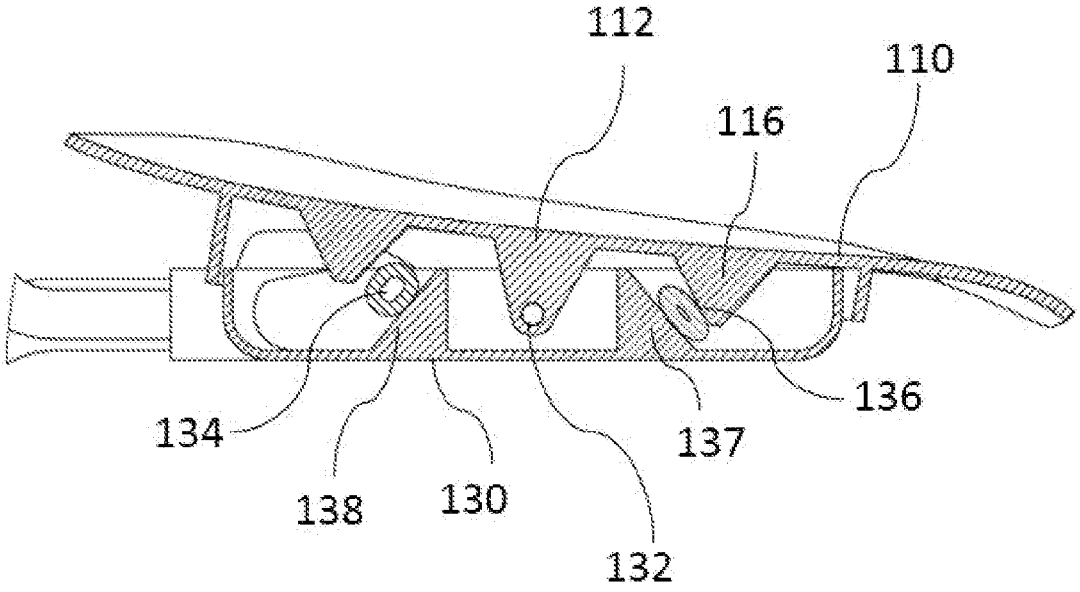
FIG. 16 is a cross-sectional view of an articulation mechanism showing a seat pan tilted in second (forward) direction according to an embodiment of the present technology.

Referring now to FIGS. 15 and 16 which show the articulation mechanism for the seat pan 110.

Forward and backward tilting motion of the seat pan 110 is produced when the seat pan 110 rotates about the seat axles 132 on the seat fulcrum 112.

The first resilient component 134 and the second resilient component 136 are initially in a substantially uncompressed state, i.e. the seat pan 110 is in a neutral position.

When the seat pan 110 is tilted forward (e.g. in an anti-clockwise direction when viewed from the left-hand side of the chair 100), the first resilient component 134 is compressed between the first stop 114 and the surface of the undercarriage 130 that partially defines the first recess 137.

The first resilient component 134 provides a restorative force to urge the seat pan 110 to rotate towards the non-tilted position (e.g. in clockwise orientation around the seat axles 132 when viewed from the left-hand side of the chair 100).

When the seat pan 110 is tilted backwards (e.g. in a clockwise direction when viewed from the left-hand side of the chair 100), the second resilient component 136 is compressed between the second stop 116 and a surface 140 of the undercarriage 130 which partially defines the second recess 138.

The second resilient component 136 provides a restorative force, urging the seat pan 110 towards the non-tilted position (e.g. in an anti-clockwise orientation about the seat axle 132 when viewed from the left-hand side of the chair 100).

The degree of restorative force provided may depend on the nature of the resilient components 134, 136. In the illustrated example, the resilient component is a cylinder or tube of an elastomeric material, such as rubber. Persons skilled in the art will appreciate that other polymers or materials with the desired resiliency properties may be used.

The modulus of elasticity or Shore durometer rating of the resilient components 134, 136 may be selected to achieve the degree of restorative force, and range of movement, required. For example, the second resilient component 136 may be selected such that it is more resistant to compression than the first resilient component 134. This makes it more difficult for the person in the chair to recline backwards and lean on the backrest 150.

Figure 17:
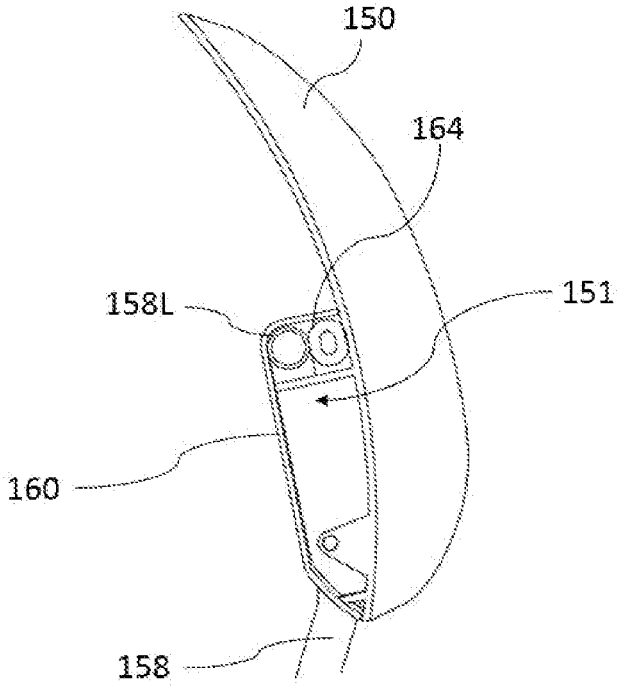
FIG. 17 is a cross-sectional view of an articulation mechanism for a backrest in a neutral position according to an embodiment of the present technology.
Figure 18:
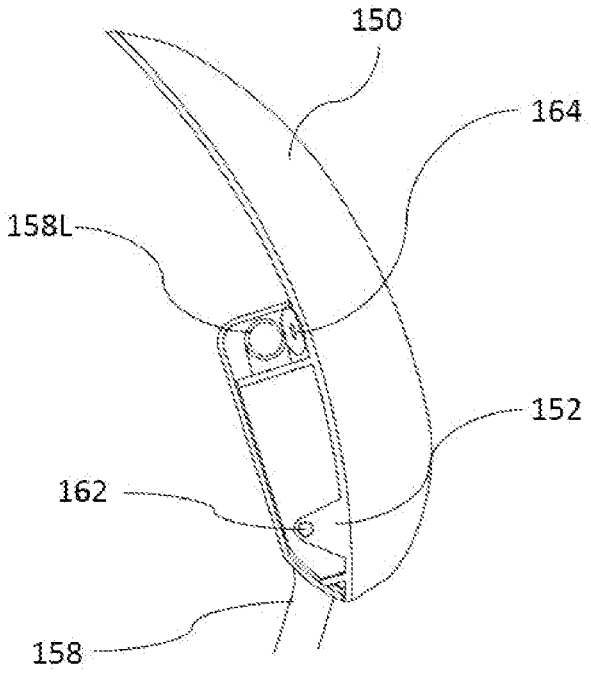
FIG. 18 is a cross-sectional view of an articulation mechanism showing a backrest in a tilted position according to an embodiment of the present technology.
Figure 19:
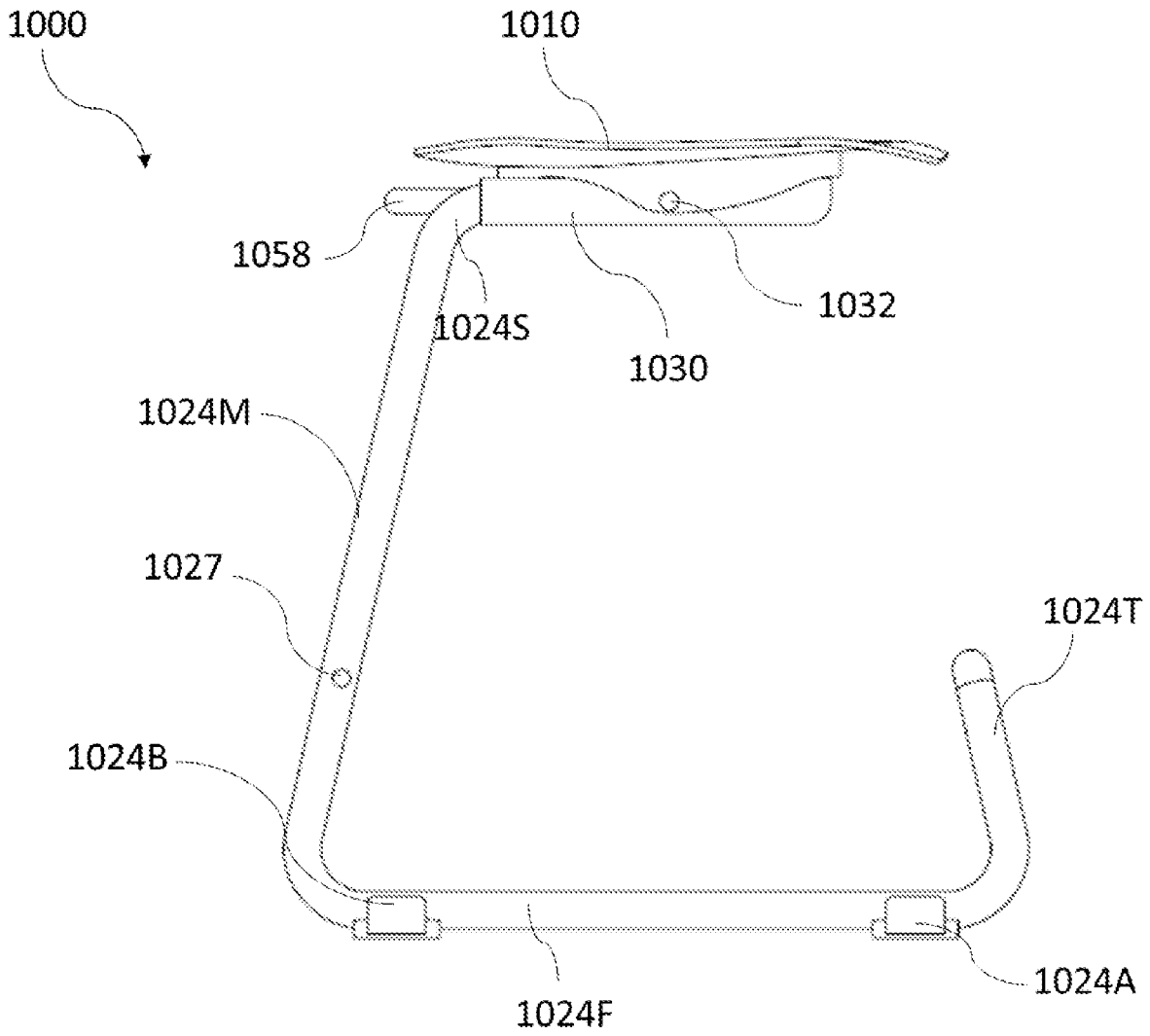
FIG. 19 is a side view of a stool according to an embodiment of the present technology.
Figure 20:
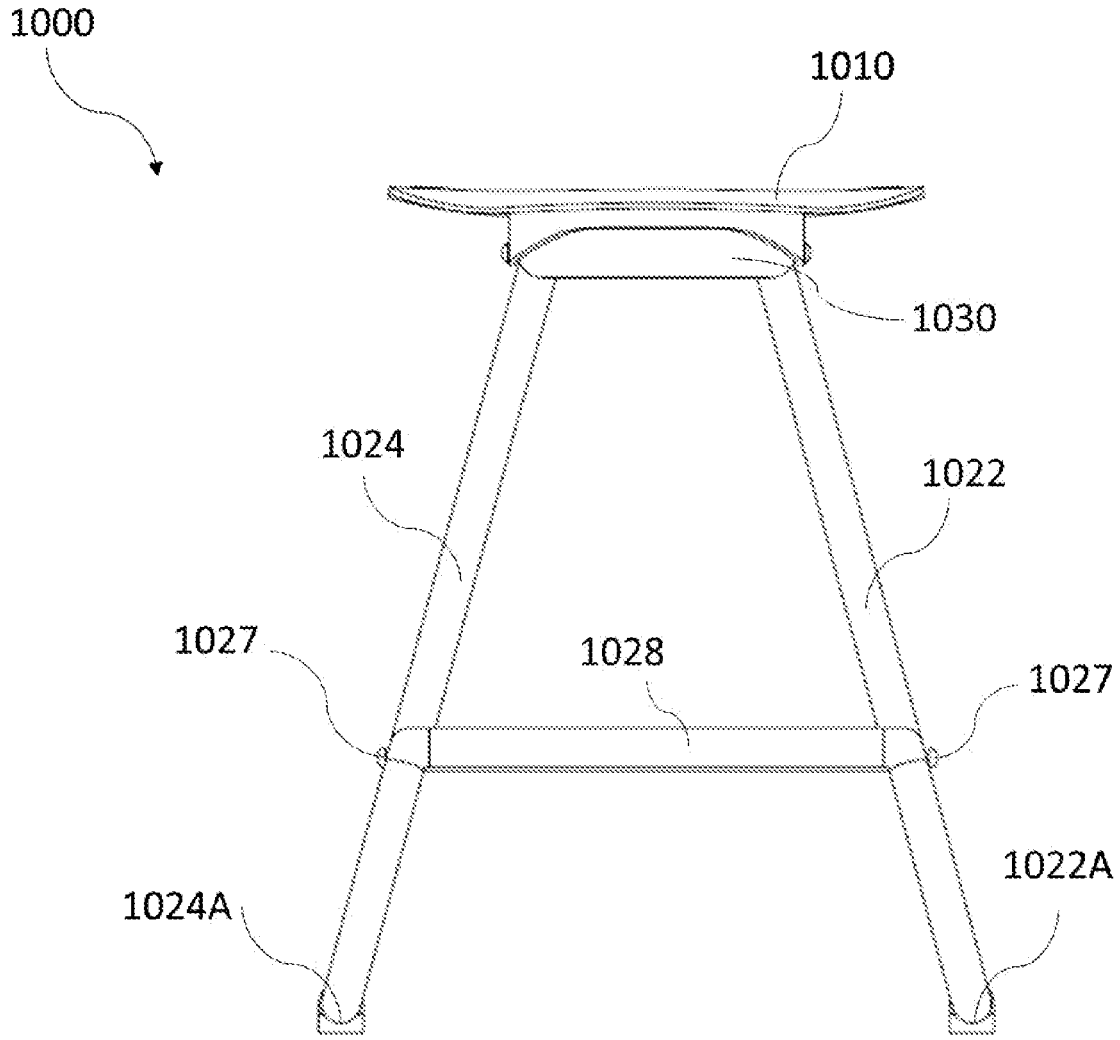
FIG. 20 is a front view of a stool according to an embodiment of the present technology.
Figure 21:
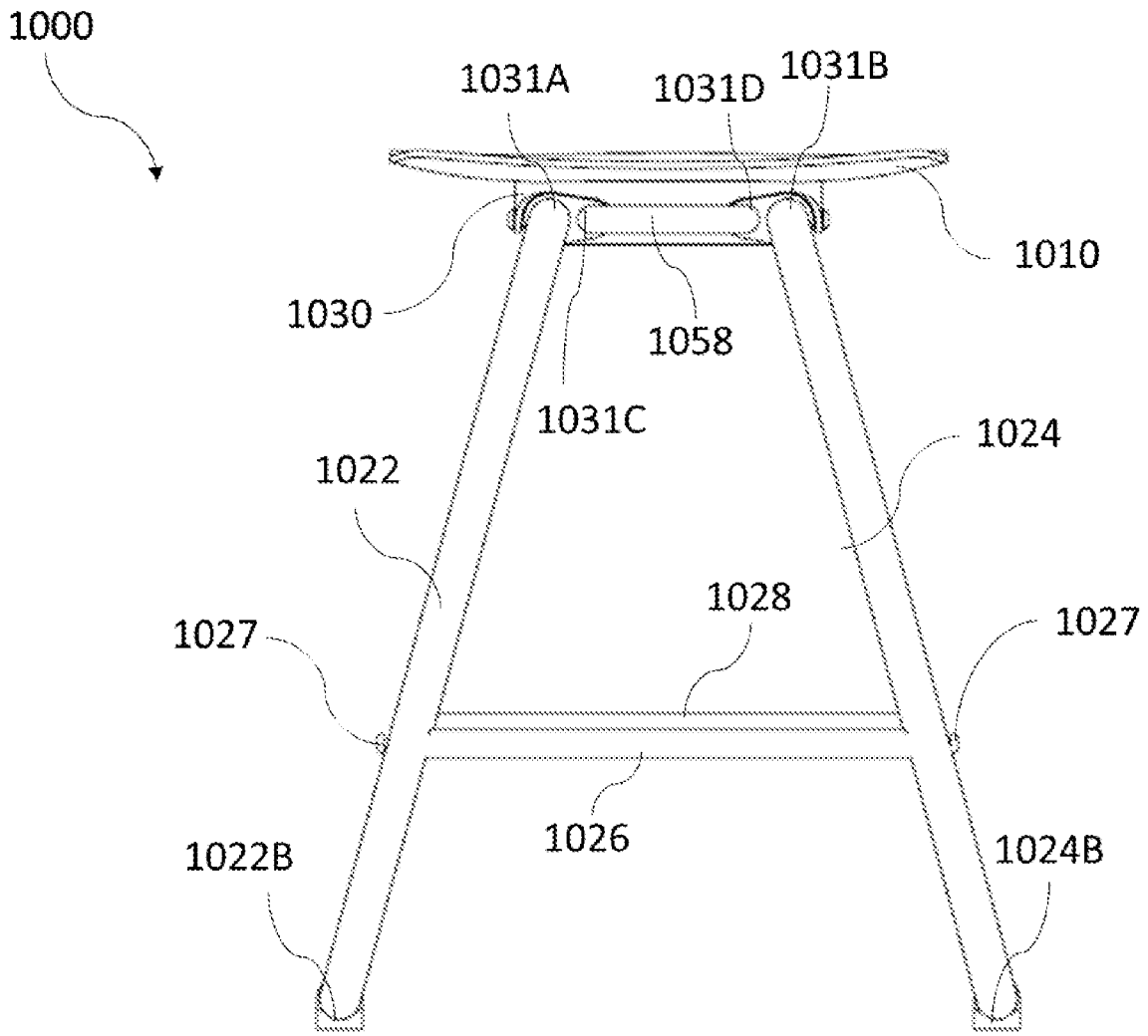
FIG. 21 is a rear view of a stool according to an embodiment of the present technology.
Figure 22:
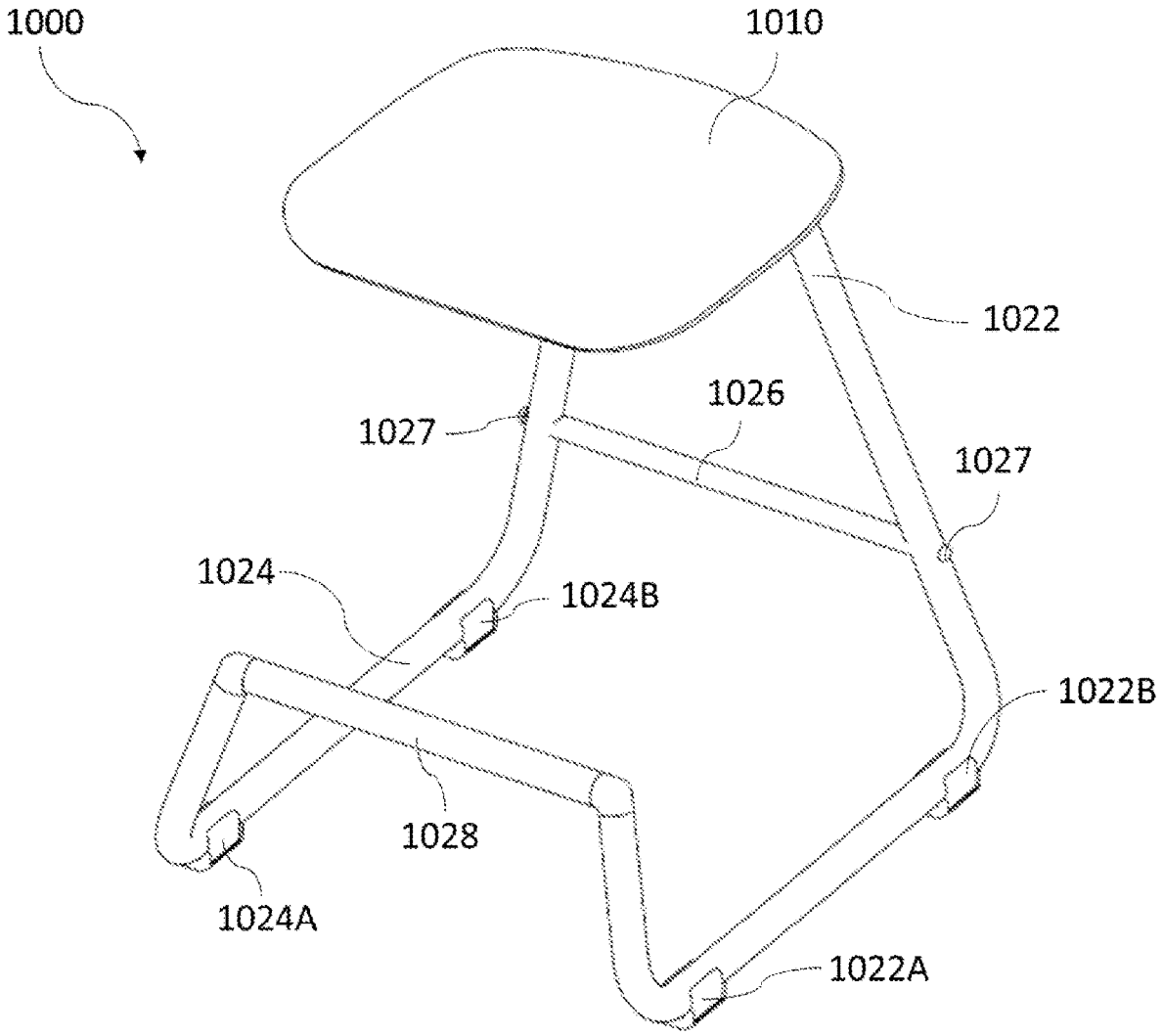
FIG. 22 is a front perspective view of a stool according to an embodiment of the present technology.
Figure 23:
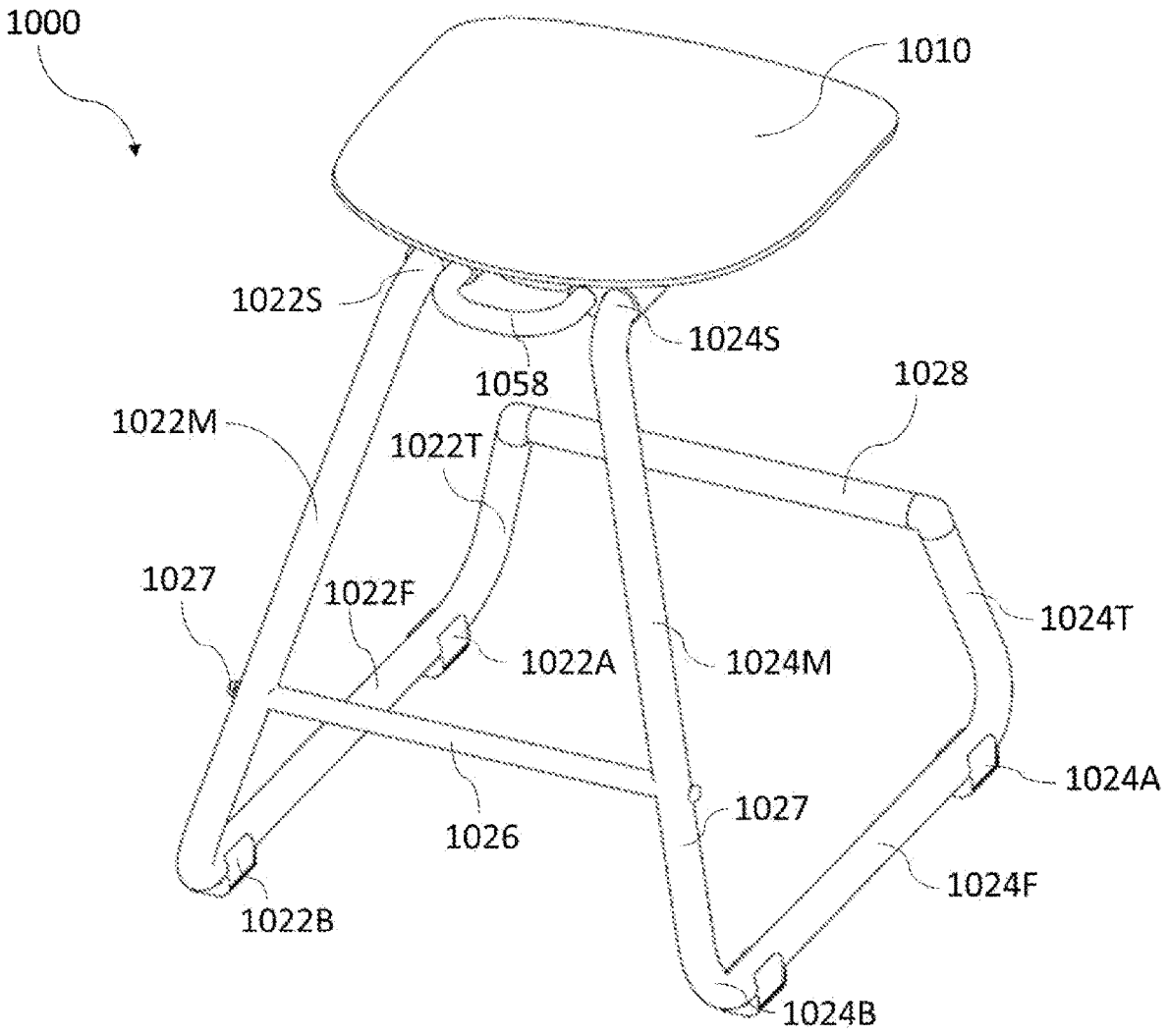
FIG. 23 is a rear perspective view of a stool according to an embodiment of the present technology.

Referring now to FIGS. 17 to 19 which show functioning of an articulation mechanism to facilitate movement of the backrest 150 relative to the backrest support 158.

The articulation mechanism includes a backrest resilient component 164 which may be a cylinder or tube of an elastomeric material, such as rubber. The modulus of elasticity or Shore durometer rating of the backrest resilient component may be selected to achieve the degree of restorative force, and range of movement, required. Persons skilled in the art will appreciate that other polymers or materials with the desired resiliency properties may be used.

As illustrated in FIG. 18, the backrest resilient component 164 is substantially uncompressed when the backrest 150 is in a neutral orientation.

The backrest 150 may include a backrest fulcrum 152 through which a backrest axle 162 passes. The axle 162 may be configured to be rotatably attached to the backrest support 158, as shown in FIGS. 9, 10, 13, 17, 18 and 19.

The backrest 150 and the fulcrum 152 may be formed as a single component, e.g. by plastic injection moulding. In an alternative embodiment (not shown in the Figures), the backrest 150 and the fulcrum 152 may be two separate components that are joined by means of fasteners, plastic welding, or a snap-lock-type arrangement.

In yet a further alternative embodiment (again not shown in the Figures), the backrest may include a cylindrical projection and the cover plate may include a socket that is configured to receive the cylindrical projection. The backrest may be configured to be rotatably attached with respect to the cover plate through the cylindrical projection and the socket.

In the illustrated embodiments, when a force is exerted on the backrest 150 in a rearward direction, the backrest 150 rotates around the axle 162. In doing so, the backrest resilient component 164 is compressed between the backrest 150 and the mid-section 158L. This position is shown in FIG. 19.

On removal of the rearward force on the backrest 150, the backrest resilient component 164 provides a restorative force to urge the backrest 150 to rotate about the axle 162 and return to the neutral position (as shown in FIG. 18).

Stool

Referring now to FIGS. 20 to 24 which show different views of a stool 1000 that includes a seat 1010, an undercarriage 1030, a first leg 1022, a second leg 1024, a brace member 1026 and a foot rest 1028.

The first leg 1022, the second leg 1024, the brace member 1026, and the undercarriage 1030 together form a frame for the stool 1000.

The frame of the stool 1000 may also include an additional support 1058 beneath the seat 1010. The additional support 1058 may be configured to be received in slots 1031C and 1031D of the undercarriage 1030. This provides additional structural strength to the undercarriage 1030 of the stool 1000.

The first leg 1022 and the second leg 1024, in the illustrated embodiments are substantially C-shaped when viewed from a lateral side of the stool 1000. The first leg 1022 includes a first portion 1022F, an upper portion 1022S, a middle portion 1022M and a fourth portion 1022T. Similarly, the second leg 1024 includes a first portion 1024F, an upper portion 1024S, a middle portion 1024M and a fourth portion 1024T.

The first portions 1022F, 1024F are configured to contact the ground or floor on which the stool 1000 bears down. The upper portions 1022S, 1024S of the respective legs 1022, 1024 are received by the undercarriage 1030, contributing to the structural strength of the undercarriage 1030.

In use, a person's weight is transmitted from each upper portion 1022S, 1024S to the respective first portions 1022F, 1024F via the respective middle portions 1022M, 1024M. The brace member 1026 is connected to the middle portions 1022M, 1024M and prevents the legs 1022, 1024 from splaying outwardly. In the illustrated embodiment, the brace member 1026 is attached to the middle portions 1022M, 1024M of the legs 1022, 1024 through fasteners 1027.

The fourth portions 1022T, 1024T extend from the respective first portions 1022F, 1024F. The foot rest 1028 is connected between the fourth portions 1022T, 1024T. The foot rest 1028 allows an elevated surface on which a person sitting on the stool 1000 can rest their feet.

The first leg 1022 and the second leg 1024 are provided with at least one foot each e.g. a forward foot 1022A, 1024A and a rearward foot 1022B, 1024B. Each foot 1022A, 1024A, 1022B, 1024B may be made from a material which has a relatively high coefficient of friction e.g. rubber. Therefore, each foot 1022A, 1024A, 1022B, 1024B may assist in preventing or limiting slipping of the stool 1000 in use.

The undercarriage 1030 and the seat pan 1010 are substantially identical to the undercarriage 130 and seat pan 110 discussed herein. Accordingly, they will not be described again in detail. Instead, like references refer to like components.

The rotation of the seat pan 1010 with respect to the undercarriage 1030 is substantially identical to that described herein with respect to the seat pan 110 and the undercarriage 130 of FIGS. 15 and 14.

The stool 1000 has an axle 1032 (or in an example nor shown here, a pair of axles, one for either side of the seat pan 1010) which connects the seat pan to the undercarriage and defines an axis of rotation. The axle(s) also pass through the legs 1022, 1024 and/or the additional support 1058, if present. This holds the seat pan 1010 and legs 1022, 1024 together with the undercarriage 1030, simplifying manufacture and assembly while also reducing part count, since separate fasteners may not be required.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

The entire disclosures of all applications, patents and publications cited above and below, if any, are herein incorporated by reference.

Reference to any prior art in this specification is not, and should not be taken as, an acknowledgement or any form of suggestion that that prior art forms part of the common general knowledge in the field of endeavour in any country in the world.

The technology may also be said broadly to consist in the parts, components, characteristics and features referred to or indicated in the specification of the application, individually or collectively, in any or all combinations of two or more of said parts, components, characteristics or features.

Aspects of the present technology have been described by way of example only and it should be appreciated that modifications and additions may be made thereto without departing from the scope thereof as defined herein.

Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the technology and without diminishing its attendant advantages. It is therefore intended that such changes and modifications be included within the present technology.

The invention claimed is:

1. A seat which comprises:

a frame including at least one leg that is configured to bear down on a surface;

an undercarriage which is configured to receive the leg;

a seat pan which is rotatably mounted to the undercarriage, wherein the seat pan is rotatable about an horizontal axis of rotation relative to the undercarriage; and wherein the undercarriage includes a first recess located forward of the horizontal axis of rotation and a first resilient component in the first recess and a second recess located rearward of the horizontal axis of rotation and a second resilient component in the second recess, wherein the seat pan includes a first stop and a second stop located on a bottom surface of the seat pan, and further wherein, on rotation of the seat pan relative to the undercarriage in a first direction, the first resilient component is compressed between the undercarriage and the first stop.

2. The seat according to claim 1, wherein the at least one leg is substantially C-shaped and includes a first portion which is configured to bear down on a surface on which the seat rests, an upper portion which is configured to be received by the undercarriage, and a middle portion which connects the upper portion to the first portion.

3. The seat according to claim 2, wherein the first portion and the upper portion are substantially parallel to each other.

4. The seat according to claim 1, wherein a) the at least one leg is attached to the undercarriage by a snap-fit or push-fit mechanism; and/or the undercarriage includes one or more slots or channels which are each configured to receive at least a portion of the at least one leg to facilitate attachment of the at least one leg to the undercarriage and/or b) the undercarriage includes one or more slots or channels which are each configured to receive at least a portion of the at least one leg to facilitate attachment of the at least one leg to the undercarriage.

5. The seat according to claim 1, wherein the resilient component is one of at least two resilient components, and wherein the stop is one of at least two stops located on the bottom surface of the seat pan, wherein in use rotation of the seat pan with respect to the undercarriage in a first direction compresses the first resilient component between the first stop of the seat pan and the undercarriage, and rotation of the seat pan with respect to the undercarriage in a second direction compresses the second resilient component between the second stop of the seat pan and the undercarriage.

6. The seat according to claim 5, wherein the first resilient component is located at or towards a front portion of the undercarriage and the second resilient component is located at or towards a rear portion of the seat.

7. The seat according to claim 5, wherein the modulus of elasticity of the first resilient component is substantially the same as the modulus of elasticity of the second resilient component.

8. The seat according to claim 5, wherein the undercarriage includes a recess to receive the second resilient component.

9. The seat according to claim 5, wherein the resilient component(s) is/are positioned and located to be compressed between the bottom surface of the seat pan and the undercarriage on rotation of the seat pan.

10. The seat according to claim 5, wherein the bottom surface is structured to define a fulcrum.

11. The seat according to claim 10, wherein a) the axis of rotation passes through the fulcrum; and/or b) the fulcrum has a substantially triangular cross-section.

12. The seat according to claim 1, wherein the seat pan is attached to the undercarriage by an axle passing through at least a portion of the length of the axis of rotation.

13. The seat according to claim 12, wherein the axle passes through the at least one leg.

14. The seat according to claim 1, wherein the seat further includes a backrest.

15. The seat according to claim 14 wherein the backrest further includes a backrest support that is received by the undercarriage.

16. The seat according to claim 15, wherein a) the backrest is attached to the backrest support by at least one axle; and/or b) the undercarriage includes one or more backrest support slots to receive at least a portion of the backrest support.

17. The seat according to claim 15 wherein a) the backrest is configured to rotate with respect to the backrest support; and/or b) the axis of rotation passes through the backrest support.

18. The seat according to claim 14, wherein the backrest further includes a backrest fulcrum located on a rear surface of the backrest.

19. The seat according to claim 18, wherein the backrest fulcrum is a) located at or towards a lower end of the backrest; and/or b) is structured to have a substantially triangular cross-section.

20. The seat according to claim 14, wherein the seat further includes one or more backrest resilient components, wherein a) the backrest resilient component(s) is/are located between the backrest and the backrest support; and/or b) the one or more backrest resilient components are located at or towards an upper end of the backrest.

21. The seat according to claim 20, wherein the backrest includes a backrest stop that restricts rotation of the backrest, and wherein the backrest resilient component(s) is/are compressed between a rear surface of the backrest and the backrest stop in use on rotation of the backrest.

22. The seat according to claim 1, wherein a) the seat pan is a single piece component; and/or b) the at least one leg is a single component.

23. A kitset for a seat, the kitset comprising:

a frame including at least one leg that is configured to bear down on a surface;

an undercarriage which is configured to receive the leg;

a seat pan which is rotatably mounted to the undercarriage, wherein the seat pan is rotatable about an axis of rotation relative to the undercarriage; and wherein the undercarriage includes a recess and a resilient component in the recess, wherein the seat pan includes a stop located on a bottom surface of the seat pan, and further wherein, on rotation of the seat pan relative to the undercarriage, the resilient component is compressed between the undercarriage and the stop.

* * * * *